US008814307B2

(12) United States Patent
Ebisawa et al.

(10) Patent No.: US 8,814,307 B2
(45) Date of Patent: Aug. 26, 2014

(54) IMAGE FORMING APPARATUS

(71) Applicant: Riso Kagaku Corporation, Tokyo (JP)

(72) Inventors: Takashi Ebisawa, Tsukuba (JP); Ryo Terakado, Tsukuba (JP); Mamoru Saitou, Tsukuba (JP); Toshihide Maesaka, Tsukuba (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/029,868

(22) Filed: Sep. 18, 2013

(65) Prior Publication Data

US 2014/0085371 A1 Mar. 27, 2014

(30) Foreign Application Priority Data

Sep. 21, 2012 (JP) ..... 2012-208188

(51) Int. Cl.
*B41J 2/045* (2006.01)

(52) U.S. Cl.
CPC ..... *B41J 2/04501* (2013.01)
USPC ..... 347/14; 347/15; 347/78

(58) Field of Classification Search
CPC .... B41J 29/38; B41J 2/04526; B41J 2/04505; B41J 2/04508; B41J 2/04561; B41J 2/2135; B41J 2/04573; B41J 2/2132; B41J 2/45
USPC ..... 347/14–16, 19, 37, 41, 43, 77–82
See application file for complete search history.

(56) References Cited

U.S. PATENT DOCUMENTS

| | | | | |
|---|---|---|---|---|
| 7,762,644 | B2 * | 7/2010 | Kinoshita | 347/19 |
| 2013/0335470 | A1 * | 12/2013 | Saitou | 347/14 |
| 2014/0078204 | A1 * | 3/2014 | Saitou et al. | 347/14 |

FOREIGN PATENT DOCUMENTS

JP 2010173178 A 8/2010

* cited by examiner

*Primary Examiner* — Thinh Nguyen
(74) *Attorney, Agent, or Firm* — Nath, Goldberg & Meyer; Jerald L. Meyer; Stanley N. Protigal

(57) ABSTRACT

An image forming apparatus includes a controller configured to adjust ink ejection amounts from nozzles in a downstream nozzle array on a basis of a bypassing air flow degree. The bypassing air flow degree is calculated based on an ejection density of ink ejected from nozzles in an upstream nozzle array on a recording medium and indicates a generation degree of a bypassing air flow generated when a transfer air flow generated by transfer of the recording medium bypasses a self-generated air flow generated by ink ejected from the nozzles in the upstream nozzle array. The downstream nozzle array is a nozzle array located downstream in a transfer direction among a plurality of nozzle arrays. The upstream nozzle array is a nozzle array located upstream in the transfer direction among the plurality of nozzle arrays.

11 Claims, 19 Drawing Sheets

| HEAD NO. | NOZZLE NUMBER | CORRECTION COEFFICIENT |
|---|---|---|
| HEAD 1 (DOWNSTREAM SIDE) | #297 | 0.5 |
| HEAD 2 (UPSTREAM SIDE) | #4 | 0.5 |

| HEAD NO. | NOZZLE NUMBER | CORRECTION COEFFICIENT | | |
|---|---|---|---|---|
| | | COVERAGE RATIO IN AREA NEAR SEAM (NUMBER OF NOZZLES EJECTING INK × NUMBER OF PRINTED LINES IN AREA NEAR SEAM) | | |
| | | ~0.5 | 0.5~0.7 | 0.7~1.0 |
| HEAD 1 | #297 | 0.5 | 0.75(0.5+0.25) | 1.0(0.5+0.5) |
| HEAD 2 | #4 | 0.5 | 0.75(0.5+0.25) | 1.0(0.5+0.5) |

| NOZZLE NUMBER | CORRECTION COEFFICIENT |
|---|---|
| #1 | 0.9 |
| #2 | 0.93 |
| #3 | 0.95 |
| #4 | 0.97 |
| #5 | 0.97 |
| | |
| #296 | 0.97 |
| #297 | 0.96 |
| #298 | 0.94 |
| #299 | 0.92 |
| #300 | 0.9 |

| NOZZLE NUMBER | CORRECTION COEFFICIENT | | |
|---|---|---|---|
| | END AREA COVERAGE RATIO (NUMBER OF NOZZLES EJECTING INK × NUMBER OF PRINTED LINES IN END AREA) | | |
| | ~0.5 | 0.5~0.7 | 0.7~1.0 |
| #1 | 0.9 | 1 | 1 |
| #2 | 0.93 | 0.9 | 0.87 |
| #3 | 0.95 | 0.9 | 0.87 |
| #4 | 0.97 | 0.95 | 0.95 |
| #5 | 0.97 | 0.97 | 0.95 |
| | | | |
| #296 | 0.97 | 0.97 | 0.97 |
| #297 | 0.96 | 0.94 | 0.92 |
| #298 | 0.94 | 0.94 | 0.94 |
| #299 | 0.92 | 0.9 | 0.87 |
| #300 | 0.9 | 0.87 | 0.85 |

| NOZZLE NUMBER | CORRECTION COEFFICIENT |
|---|---|
| #1 | 0.97 |
| #2 | 0.97 |
| #3 | 0.97 |
| #4 | 1 |
| #5 | 0.98 |
| #6 | 0.92 |
| #7 | 1 |
| --- | --- |
| #298 | 0.97 |
| #299 | 0.91 |
| #300 | 0.97 |

FIG. 24
| NOZZLE NUMBER | CORRECTION COEFFICIENT | | |
|---|---|---|---|
| | INTRA-HEAD DATA DENSITY (NUMBER OF NOZZLES EJECTING INK × NUMBER OF PRINTED LINES × NUMBER OF DROPS) | | |
| | ~0.5 | 0.5~0.7 | 0.7~1.0 |
| #1 | 0.97 | 0.97 | 0.97 |
| #2 | 0.97 | 1.00(0.97+0.03) | 1.02(0.97+0.05) |
| #3 | 0.97 | 0.97 | 0.97 |
| #4 | 1 | 1.02(1.00+0.02) | 1.04(1.00+0.04) |
| #5 | 0.98 | 0.98 | 0.98 |
| #6 | 0.92 | 0.93(0.92+0.01) | 0.95(0.92+0.03) |
| #7 | 1 | 1 | 1 |
| ⋮ | ⋮ | ⋮ | ⋮ |
| #298 | 0.97 | 0.99(0.97+0.02) | 1.01(0.97+0.04) |
| #299 | 0.91 | 0.91 | 0.91 |
| #300 | 0.97 | 1.00(0.97+0.03) | 1.02(0.97+0.05) |
| | ↑CORRECTION COEFFICIENT IS NOT CHANGED | ↑CORRECTION COEFFICIENT IS SLIGHTLY INCREASED | ↑CORRECTION COEFFICIENT IS INCREASED |
FIG. 25A
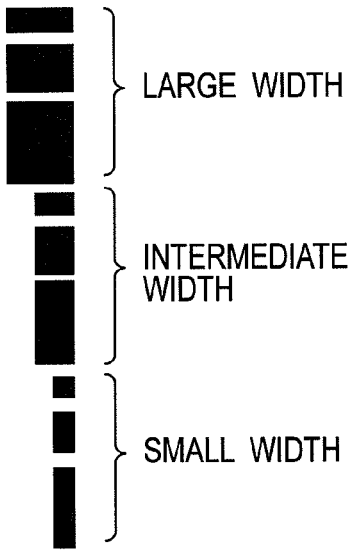
FIG. 25B
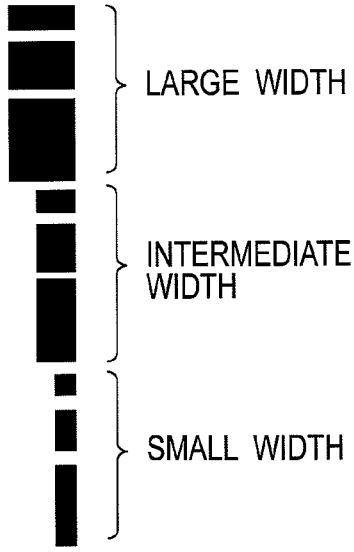

IMAGE FORMING APPARATUS

CROSS REFERENCE TO RELATED APPLICATION

This application is based upon and claims the benefit of priority from the prior Japanese Patent Application No. 2012-208188, filed on Sep. 21, 2012, the entire contents of which are incorporated herein by reference.

BACKGROUND

1. Technical Field

The present invention relates to an image forming apparatus configured to form an image by ejecting ink from an inkjet head to a recording medium transferred along a transfer route.

2. Related Art

A line inkjet printing apparatus is one type of image forming apparatus. The line inkjet printing apparatus uses a long line inkjet head in which nozzles configured to eject ink are arranged over a length equal to or larger than the width of a printing area. The line inkjet printing apparatus forms an image by ejecting ink droplets from the nozzles of the inkjet head toward the recording medium below the inkjet head while moving and transferring the recording medium relative to the inkjet head in a transfer direction intersecting an arrangement direction of the nozzles without moving the inkjet head.

In such a line inkjet printing apparatus, ink chambers communicating with the nozzles are provided inside the inkjet head and the capacities of the ink chambers are changed (increased and decreased) by using drive signals to eject the ink droplets from the nozzles. Accordingly, when the number of the nozzles is increased to improve the resolution in a main scanning direction which is the nozzle arrangement direction, two nozzle arrays are provided in one inkjet head at positions offset from each other in the transfer direction in order to secure an arrangement space for the ink chambers in the inkjet head in which a dimension in the main scanning direction is limited.

When two nozzle arrays offset from each other in the transfer direction are provided in the inkjet head, the nozzle arrays are arranged to be offset from each other by a half pitch in the main scanning direction. The ink chambers are thus arranged in the inkjet head in a zigzag pattern and the resolution can be made higher than that in a case where the ink chambers are arranged in a straight line in the main scanning direction.

When the recording medium is transferred to a position directly below the head, an air flow (hereafter, referred to as transfer air flow) from an upstream side to a downstream side in the transfer direction is generated. Accordingly, in a non-contact printing method of ejecting the ink droplets from the nozzles to the recording medium, the ink droplets are affected by the transfer air flow and are swept downstream in the transfer direction of the recording medium. As a result, so-called landing deviation in which the ink droplets deviate from desired trajectories and applied onto the recording medium occurs. This is a factor causing deterioration in image quality.

To counter such a problem, in Japanese Patent Application Publication No. 2010-173178, when ink droplets are ejected while an inkjet head having multiple nozzles and a recording medium are moved relative to each other in a direction intersecting an arrangement direction of the nozzles, the ejection is controlled in such a way that the ejection is controlled in such a way that the droplet with a smaller amount is ejected at a faster speed. This control can suppress the landing deviation of ink droplets due to the transfer air flow.

SUMMARY

In some cases, the ink droplets ejected from the nozzles of the inkjet head toward the recording medium generate an air flow (hereafter, referred to as a self-generated air flow) in a direction different from that of the aforementioned transfer air flow. The self-generated air flow flows toward a position directly below the nozzles in the same direction as the ink droplets ejected from the nozzles. Depending on its strength, the self-generated air flow becomes a factor blocking the aforementioned transfer air flow. When the transfer air flow is blocked by the self-generated air flow, the transfer air flow changes to a bypassing air flow which bypasses the self-generated air flow and then flows downstream in the transfer direction.

When such a bypassing air flow is generated in the aforementioned nozzle array on the upstream side in the transfer direction, the bypassing air flow including a main scanning direction component passes through the position directly below the nozzles in the nozzle array on the downstream side in the transfer direction. Ink droplets ejected from the nozzles are thereby swept away also in the main scanning direction and deterioration in image quality cannot be sufficiently suppressed only by suppressing the landing deviation corresponding to the transfer air flow as in the conventional technique.

An object of the present invention is to provide an image forming apparatus configured to form an image on a recording medium transferred along a transfer route by ejecting ink from nozzles in multiple nozzles arrays arranged at positions offset from each other in a transfer direction of the recording medium, the image forming apparatus being capable of improving landing position accuracy of ink droplets ejected from the nozzles in the nozzle array on a downstream side in the transfer direction and thereby forming an excellent image in which landing deviation is suppressed.

An image forming apparatus in accordance with some embodiments includes a transfer route configured to transfer a recording medium in a transfer direction, an inkjet head arranged above the transfer route and including a plurality of nozzles arrays, the plurality of nozzles arrays being arranged at positions offset from one another in the transfer direction and having nozzles configured to eject ink to form an image on the recording medium, and a controller configured to adjust ink ejection amounts from the nozzles in a downstream nozzle array on a basis of an ejection density of ink ejected from the nozzles in an upstream nozzle array on the recording medium. The downstream nozzle array is a nozzle array located downstream in the transfer direction among the plurality of nozzle arrays. The upstream nozzle array is a nozzle array located upstream in the transfer direction among the plurality of nozzle arrays. The controller is configured to adjust the ink ejection amounts from the nozzles in the downstream nozzle array on a basis of a bypassing air flow degree calculated based on the ejection density and indicating a generation degree of a bypassing air flow generated when a transfer air flow generated by transfer of the recording medium bypasses a self-generated air flow generated by ink ejected from the nozzles in the upstream nozzle array.

In the configuration described above, in a case where the image forming apparatus forms the image on the recording medium transferred along the transfer route by ejecting ink from nozzles in multiple nozzles arrays arranged at positions offset from each other in the transfer direction of the recording medium, the image forming apparatus can improve landing position accuracy of the ink droplets ejected from the nozzles in the nozzle array on the downstream side in the transfer direction and thereby form an excellent image in which the landing deviation is suppressed.

Specifically, in the configuration described above, in a case where multiple nozzle arrays exist in the inkjet head while being spaced away in the transfer direction, the degree of a self-generated air flow generated between the nozzles and the recording medium along an ejection direction of the ink increases (transfer route) as the ejection density of the ink of the nozzles in the upstream nozzle array increases.

When a self-generated air flow degree indicating this degree increases, the transfer air flow generated by the transfer of the recording medium and flowing from the upstream side to the downstream side in the transfer direction is blocked by the self-generated air flow. The transfer air flow thereby changes to a bypassing air flow which bypasses the self-generated air flow and then flows downstream in the transfer direction. In other words, the bypassing air flow is generated at a degree corresponding to the self-generated air flow. When such a bypassing air flow is generated in the downstream nozzle array, the ink ejected from the nozzles in the downstream nozzle array is swept away in the main scanning direction by the bypassing air flow.

To counter this, the controller controls the ink ejection amounts of the nozzles in the downstream nozzle array on the basis of the bypassing air flow degree which is calculated based on the ejection density of the ink ejected from the nozzles in the upstream nozzle array and which indicates the generation degree of the bypassing air flow.

Thus, even when the self-generated air flow is generated along the ink ejection direction in the upstream nozzle array and the bypassing air flow is generated in the downstream nozzle array by the effect of the self-generated air flow, the ink ejection amounts are adjusted in consideration of the bypassing air flow and the ink ejected from the nozzles in the downstream nozzle array is prevented from being swept away in the main scanning direction. Hence, an excellent image in which the landing deviation is suppressed can be formed.

The ejection density may be determined based on at least one of a number of the nozzles consecutive in a main scanning direction orthogonal to the transfer direction which eject ink or a number of lines consecutive in the transfer direction which include dots formed by ejection of ink from the same nozzle.

In the configuration described above, when the consecutive nozzles adjacent to each other in the main scanning direction eject the ink in the upstream nozzle array, the multiple self-generated air flow are combined and spread in a strip shape (wall shape). Accordingly, the effect of blocking the transfer air flow increases compared to the case where there is one stream of the self-generated air flow. Moreover, when the same nozzle ejects the ink to the dots in multiple lines consecutive in the transfer direction, the cycle of ejection of the ink from the nozzle becomes short. Hence, the stability of the self-generated air flow generated by the ejection of the ink increases and the self-generated air flow degree increases.

To counter this, the following operations can be performed. The ink ejection density of the nozzles in the upstream nozzle array is determined based on the number of the nozzles consecutive in the main scanning direction which eject the ink and the number of lines consecutive in the transfer direction which include dots formed by ejection of ink from the same nozzle, the numbers relating to the self-generated air flow degree determining the bypassing air flow degree. Then, the ink ejection amounts are adjusted in consideration of the generation of the bypassing air flow by using the determined ejection density and the ink ejected from the nozzles in the downstream nozzle array is thereby prevented from being swept away in the main scanning direction. Hence, an excellent image in which the landing deviation is suppressed can be formed.

The ejection density may be determined based on a number of ink droplets ejected to a same dot by the same nozzle.

In the configuration described above, in a case where a gradation is adjusted by changing the number of ink droplets ejected to the same dot by the same nozzle, the continuous generation time of the self-generated air flow becomes longer as the number of ink droplets ejected to the same dot increases. Hence, the stability of the self-generated air flow generated by the ejection of the ink increases and the self-generated air flow degree increases.

To counter this, the following operation can be performed. The ink ejection density of the nozzles in the upstream nozzle array is determined in consideration of the number of ink droplets ejected to the same dot by the same nozzle, in addition to the number of the nozzles consecutive in the main scanning direction which eject the ink and the number of lines consecutive in the transfer direction which include the dots formed by ejection of the ink from the same nozzle, the number of ink droplets relating to the self-generated air flow degree determining the bypassing air flow degree. Then, the ink ejection amounts are adjusted in consideration of the generation of the bypassing air flow by using the determined ejection density and the ink ejected from the nozzles in the downstream nozzle array is thereby prevented from being swept away in the main scanning direction. Hence, an excellent image in which the landing deviation is suppressed can be formed.

The inkjet head may include a plurality of head blocks arranged in a zigzag pattern along a main scanning direction orthogonal to the transfer direction. The plurality of nozzle arrays may be disposed in each of the head blocks. For each of the head blocks, the controller may be configured to adjust the ink ejection amounts from the nozzles in the downstream nozzle array on a basis of the bypassing air flow degree.

In the configuration described above, when the inkjet head is formed such that the head blocks each having the multiple nozzle arrays at positions offset from each other in the transfer direction are arranged in the zigzag pattern along the main scanning direction, the controller controls the ink ejection amounts of the nozzles in the downstream nozzle array of each head block.

Hence, in a case where a long inkjet head is formed by using multiple head blocks in a line printer which performs printing over the entire width in the main scanning direction in one operation and each head block includes the nozzle array on the upstream side and the nozzle array on the downstream side in the transfer direction, the ink ejection amounts are controlled based on the bypassing air flow degree in each head block. This prevents the ink ejected from the nozzles in the downstream nozzle array from being swept away in the main scanning direction due to the effect of the bypassing air flow even in the case where the inkjet head is formed by using the multiple head blocks. Hence, an excellent image in which the landing deviation is suppressed can be formed.

The controller may include a seam correction unit configured to correct an ink ejection amount of ink ejected from each of the nozzles located in a seam portion by using a correction content set based on an interval between the nozzles in the main scanning direction. The seam portion is a portion in which the head blocks adjacent to each other in the main scanning direction overlap each other in the transfer direction. The controller may be configured to further correct the correction content used by the seam correction unit of the ink ejection amounts from the nozzles in the downstream nozzle array on a basis of the bypassing air flow degree.

In the configuration described above, in the seam portion of two of the head blocks adjacent to each other in the main scanning direction, in some cases, an interval between the nozzles adjacent to each other in the main scanning direction in the head blocks is different from nozzle intervals in the same head block depending on the positioning accuracy of both head blocks. When the nozzle interval in the seam portion is different from the nozzle intervals in other portions, the dot intervals of landed ink vary and a white stripe and a black stripe in the transfer direction are formed in the formed images.

In order to prevent the formation of the white stripe and the black stripe in the seam portion, the seam correction unit corrects the ink ejection amounts of the nozzles by using correction contents corresponding to the intervals between the nozzles in the seam portion.

In the correction by the seam correction unit, no consideration is made of the bypassing air flow generated in the downstream nozzle array by the transfer air flow and the self-generated air flow generated in the upstream nozzle array. Thus, the controller further corrects the correction contents of the ink ejection amounts of the nozzles in the downstream nozzle array which are used by the seam correction unit, on the basis of the ejection density of the ink ejected from the nozzles in the upstream nozzle array to the recording medium. This prevents the ink ejected from the nozzles in the downstream nozzle array from being swept away in the main scanning direction and an excellent image in which the landing deviation is suppressed can be formed.

The controller may include an arrangement-based correction unit configured to correct an ink ejection amount of each of the nozzles by using a correction content set based on arrangement of the nozzles in the inkjet head in a main scanning direction orthogonal to the transfer direction. The controller may be configured to further correct the correction content used by the arrangement-based correction unit of the ink ejection amounts from the nozzles in the downstream nozzle array on a basis of the bypassing air flow degree.

In the configuration described above, in a shear-mode inkjet head provided with multiple ink chambers which communicate with nozzles and which eject ink from the nozzles by changing their capacities, vibrations caused in the ink chambers close to the center in the main scanning direction due to change in the capacities are transmitted to the ink chambers close to the ends in the main scanning direction. Here the ink chamber closer to any one of the ends in the main scanning direction accumulates a larger amount of vibrations transmitted from the other ink chambers, which affects the ink ejection amount characteristics more significantly.

In order to eliminate the change in the ink ejection amount characteristics due to the accumulated vibrations transmitted from the other ink chambers, the arrangement-based correction unit corrects the ink ejection amounts of the nozzles by using the correction contents corresponding to the arrangement of the nozzles in the main scanning direction.

In the correction by the arrangement-based correction unit, no consideration is made of the bypassing air flow generated in the downstream nozzle array by the transfer air flow and the self-generated air flow generated in the upstream nozzle array. Thus, the controller further corrects the correction contents of the ink ejection amounts of the nozzles in the downstream nozzle array which are used by the arrangement-based correction unit, on the basis of the ejection density of the ink ejected from the nozzles in the upstream nozzle array to the recording medium. This prevents the ink ejected from the nozzles in the downstream nozzle array from being swept away in the main scanning direction and an excellent image in which the landing deviation is suppressed can be formed.

The controller may include an offset correction unit configured to correct an ink ejection amount of each of the nozzles by using a correction content set based on variation in ink ejection characteristics of the nozzles. The controller may be configured to further correct the correction content used by the offset correction unit of the ink ejection amounts from the nozzles in the downstream nozzle array on a basis of the bypassing air flow degree.

In the configuration described above, the ink ejection amounts of the nozzles vary due to individual differences (characteristic differences) among elements which eject the ink and which correspond to the nozzles.

In order to eliminate the individual differences (characteristic differences) in the ink ejection amounts of the nozzles, the offset correction unit corrects the ink ejection amounts of the nozzles by using the correction contents corresponding to the variation in the ink ejection characteristics of the nozzles.

In the correction by the offset correction unit, no consideration is made of the bypassing air flow generated in the downstream nozzle array by the transfer air flow and the self-generated air flow generated in the upstream nozzle array. Thus, the controller further corrects the correction contents of the ink ejection amounts of the nozzles in the downstream nozzle array which are used by the offset correction unit, on the basis of the ejection density of the ink ejected from the nozzles in the upstream nozzle array to the recording medium. This prevents the ink ejected from the nozzles in the downstream nozzle array from being swept away in the main scanning direction and an excellent image in which the landing deviation is suppressed can be formed.

The controller may be configured to adjust the ink ejection amount from each of the nozzles in the downstream nozzle array on a basis of the bypassing air flow degree, by using a content unique to each of the nozzles.

In the configuration described above, the changes in the ink ejection amount characteristics due to vibrations transmitted from the other ink chambers in a shear-mode inkjet head and the individual differences (characteristic differences among the elements which eject the ink and which correspond to the nozzles are contents unique to the nozzles whose positions are different in the main scanning direction.

Hence, the correction contents of the ink ejection amounts of each of the nozzles in the downstream nozzle array which are used by the arrangement-based correction unit and the offset correction unit are set to be unique contents corresponding to the individual difference (characteristic difference) of the nozzle. This uniformly prevents the ink ejected from the nozzles in the downstream nozzle array from being swept away in the main scanning direction, regardless of the positions of the nozzles in the main scanning direction. Hence, an excellent image in which the landing deviation is suppressed can be formed.

The image forming apparatus may further include a head gap adjuster configured to adjust a head gap being a gap between the inkjet head and the recording medium. The controller may be configured to adjust the ink ejection amounts of the nozzles in the downstream nozzle array, according to the head gap.

In the configuration described above, for example, when the recording medium with a large thickness such as an envelope is used, the head gap between the inkjet head and the recording medium is increased in some cases by the head gap adjuster to prevent the recording medium from colliding with the inkjet head.

When the head gap is increased and the gap between the inkjet head and the recording medium increases, the transfer air flow easily flows between the inkjet head and the recording medium and the bypassing air flow generated in the downstream nozzle array thereby easily flows. As a result, the ink ejected from the nozzles in the downstream nozzle array tends to be swept away in the main scanning direction by the bypassing air flow.

To counter this, the controller adjusts control contents of the ink ejection amounts of the nozzles in the downstream nozzle array according to the head gap, so that the ink ejection amounts of the nozzles can be controlled by using the content corresponding to the head gap even when the head gap is adjusted according to the thickness of the recording medium or the like. This prevents the ink ejected from the nozzles in the downstream nozzle array from being swept away in the main scanning direction and an excellent image in which the landing deviation is suppressed can be formed.

The controller may be configured to determine adjustment contents of the ink ejection amounts of the nozzles in the downstream nozzle array, according to a transfer speed of the recording medium.

In the configuration described above, for example, when the transfer speed of the recording medium increases, the speed of the transfer air flow increases. This changes the degree in which the transfer air flow bypasses the self-generated air flow generated in the upstream nozzle array and changes to the bypassing air flow, i.e. the bypassing air flow degree.

Hence, the control contents of the ink ejection amounts of the nozzles in the downstream nozzle array are adjusted according to the transfer speed of the recording medium, so that the ink ejection amounts of the nozzles can be adjusted by using the contents corresponding to the transfer speed of the recording medium even when the transfer speed is changed. This prevents the ink ejected from the nozzles in the downstream nozzle array from being swept away in the main scanning direction and an excellent image in which the landing deviation is suppressed can be formed.

BRIEF DESCRIPTION OF DRAWINGS

FIG. 24 is an explanatory diagram showing an example of a bypassing air flow correction table stored in the controller in FIG. 2 to correct landing deviation caused by the bypassing air flow in the inkjet printing apparatus in the third embodiment of the present invention.

FIGS. 25A and 25B are explanatory diagrams each showing an example of a test pattern used to determine correction contents of the bypassing air flow correction table in FIG. 24.

DETAILED DESCRIPTION

Figure 1:
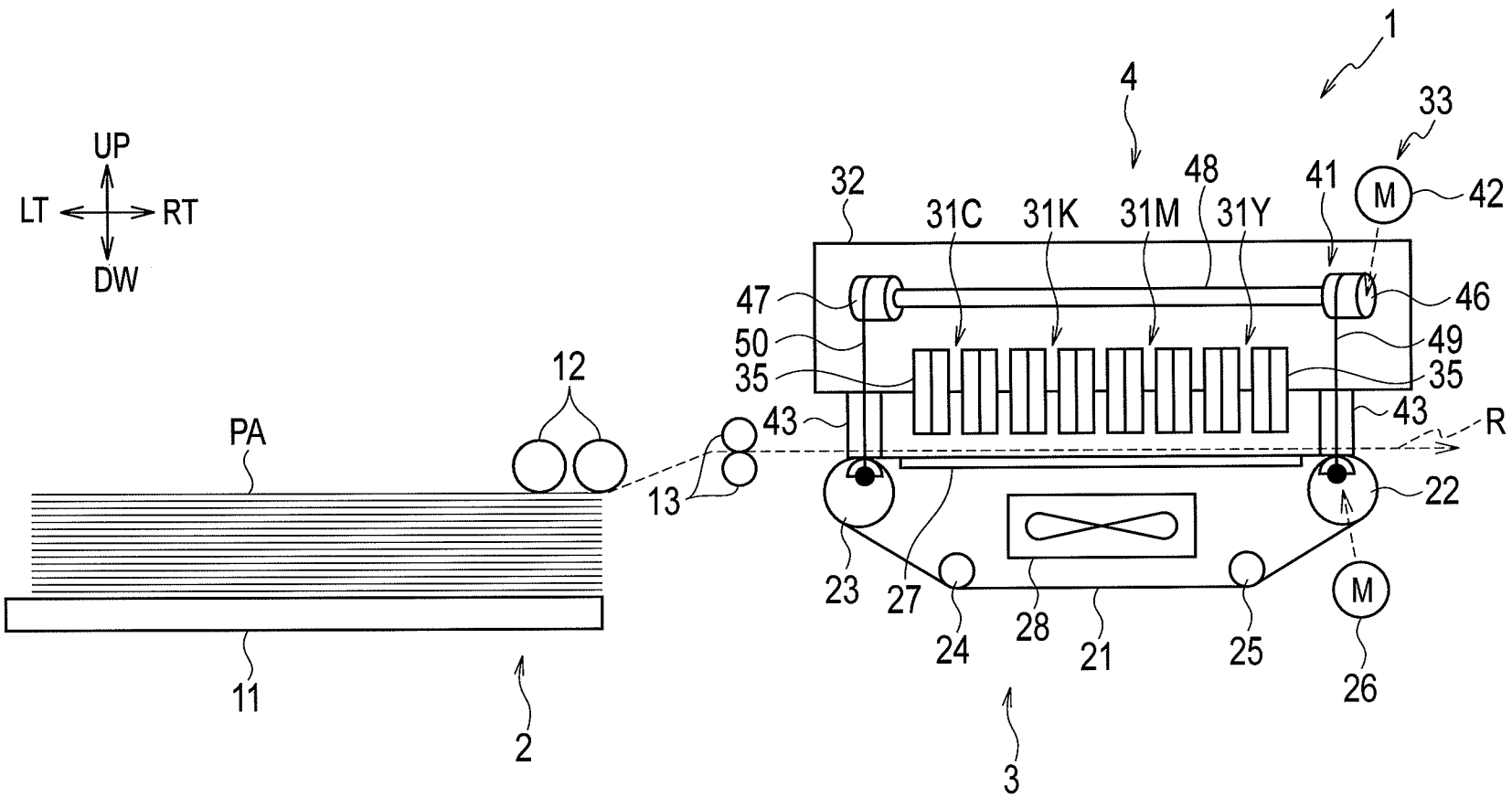
FIG. 1 is a schematic configuration diagram of an inkjet printing apparatus in a first embodiment of the present invention.

Image forming apparatuses in embodiments of the present invention are described below with reference to the drawings. The same or similar portions and constitutional elements are denoted by the same or similar reference numerals throughout the drawings. Note that the drawings are schematic and are different from the actual ones. Moreover, parts where relations and proportions of the dimensions are different among the drawings are included as a matter of course.

Furthermore, the embodiments described below are given as examples of an apparatus in which the technical idea of the present invention has taken shape. The technical idea of the present invention does not limit the arrangements and the like of the constitutional elements to those described below. In the technical idea of the present invention, various changes can be made within the scope of claims.

First Embodiment

Figure 2:
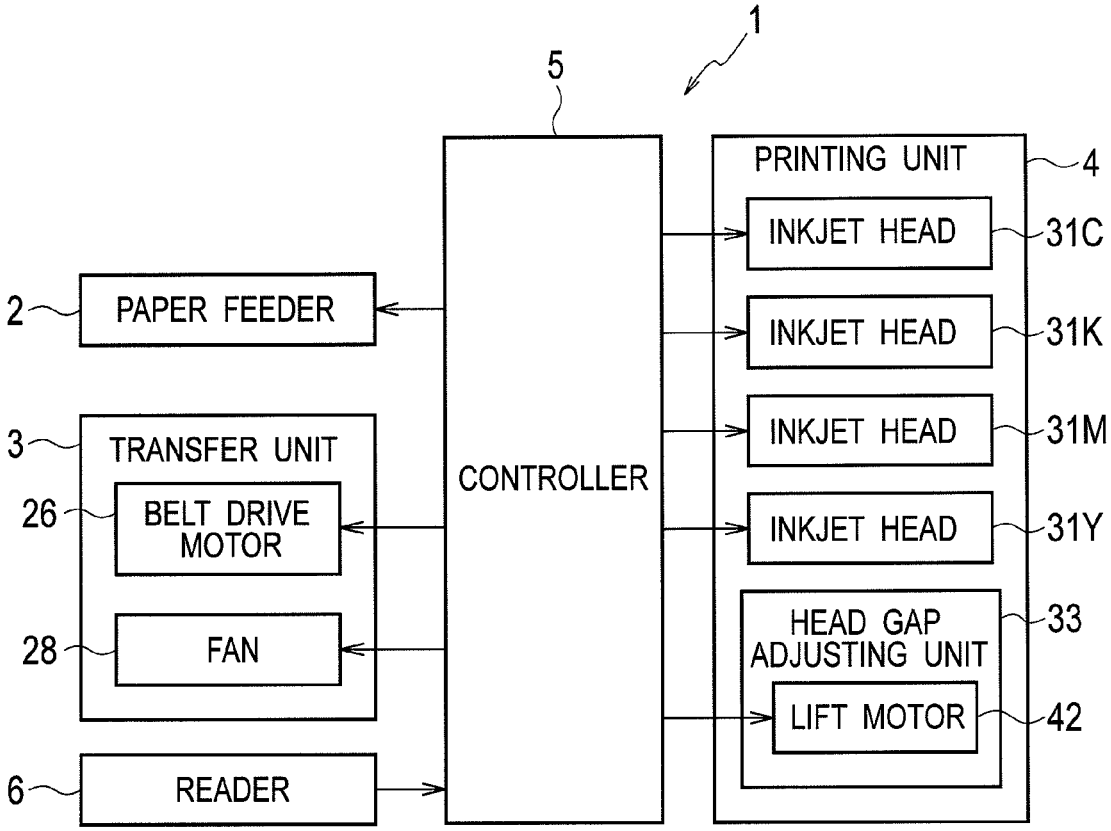
FIG. 2 is a block diagram showing a configuration of a control system of the inkjet printing apparatus in FIG. 1.
Figure 3:
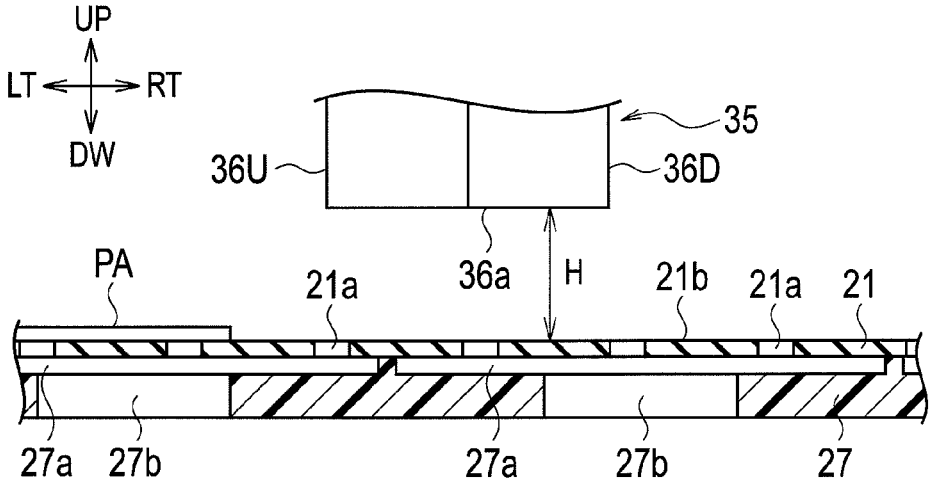
FIG. 3 is an enlarged cross-sectional view of a portion including a transfer belt and a platen plate in FIG. 1.
Figure 4:
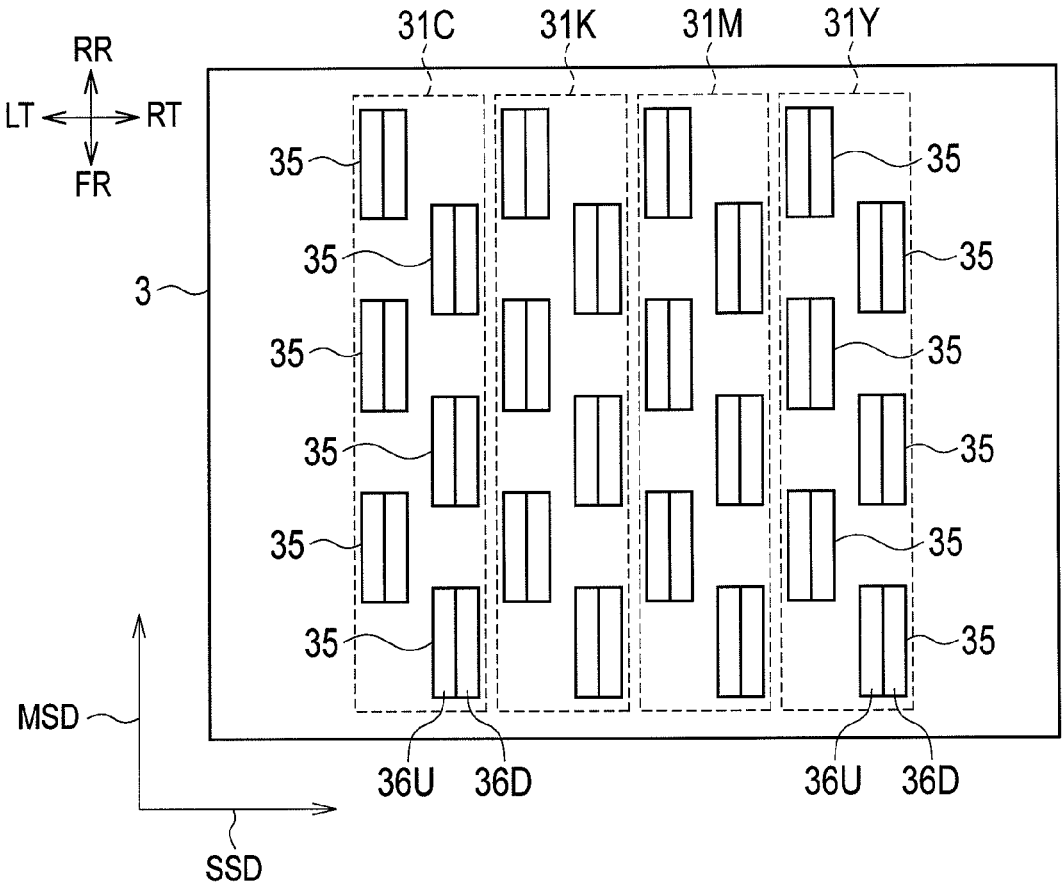
FIG. 4 is an explanatory diagram showing an arrangement of head blocks in FIG. 1.
Figure 5:
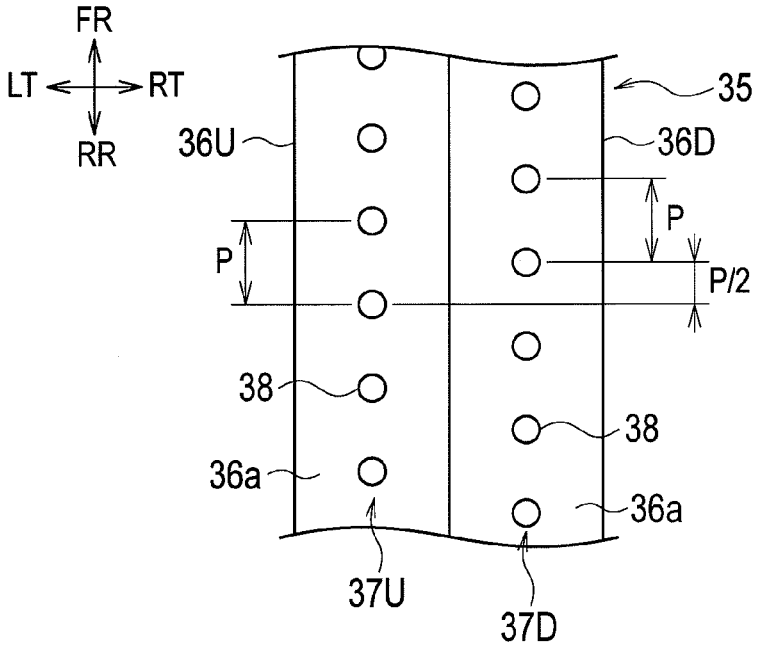
FIG. 5 is a schematic configuration diagram of the head block in FIG. 1.

FIG. 1 is a schematic configuration diagram of an inkjet printing apparatus in a first embodiment of the present invention, FIG. 2 is a block diagram showing a configuration of a control system of the inkjet printing apparatus in FIG. 1, FIG. 3 is an enlarged cross-sectional view of a portion including a transfer belt and a platen plate in FIG. 1, FIG. 4 is an explanatory diagram showing an arrangement of head blocks in FIG. 1, and FIG. 5 is a schematic configuration diagram of the head block.

In the following description, a direction toward a front surface of the sheet in FIG. 1 is assumed to be the frontward direction. Moreover, as shown in FIG. 1, up, down, left, and right in the sheet are assumed to be the upward, downward, leftward, and rightward directions. In the drawings, the upward, downward, leftward, and rightward directions are denoted by UP, DW, LT, and RT, respectively. Moreover, as shown in FIGS. 4 and 5, a direction orthogonal to the up-down direction and the left-right direction are assumed to be the front-rear direction and, in the drawings, the frontward and rearward directions are denoted by FR and RR, respectively. Furthermore, a route shown by a broken line in FIG. 1 is a transfer route R along which a paper sheet PA being a recording medium is transferred. Downstream and upstream in the following description refer to downstream and upstream in the transfer route R.

As shown in FIGS. 1 and 2, the inkjet printing apparatus 1 includes a paper feeder 2, a transfer unit 3, a printing unit 4, a controller 5, and a reader 6.

A paper feeder 2 feeds the paper sheet PA. The paper feeder 2 includes a paper feed tray 11, paper feed rollers 12, and registration rollers 13. The paper sheets PA to be used for printing are stacked on the paper feed tray 11.

The paper feed rollers 12 pick up the paper sheets PA stacked on the paper feed tray 11 one by one and transfers the paper sheets PA toward the registration rollers 13. The paper feed rollers 12 are arranged above the paper feed tray 11. The paper feed rollers 12 are rotationally driven by a not-illustrated motor.

The registration rollers 13 temporarily stop each paper sheet PA transferred by the paper feed rollers 12 and then transfer the paper sheet PA toward the transfer unit 3. The registration rollers 13 are arranged downstream of the paper feed rollers 12. The registration rollers 13 are rotationally driven by a not-illustrated motor.

The transfer unit 3 transfers the paper sheet PA transferred from the registration rollers 13. The transfer unit 3 includes a transfer belt 21, a drive roller 22, driven rollers 23 to 25, a belt drive motor 26, a platen plate 27, and a fan 28.

The transfer belt 21 is an annular belt wound around the drive roller 22 and the driven rollers 23 to 25. As shown in FIG. 3, many belt holes 21*a* which are through holes for sucking and holding the paper sheet PA are formed in the transfer belt 21. The transfer belt 21 sucks and holds the paper sheet PA on a paper-sheet holding surface (medium holding surface) 21*b* by using a sucking force generated at the belt holes 21*a* by drive of the fan 28. The paper-sheet holding surface 21*b* is an upper surface of the transfer belt 21 which is substantially horizontal between the drive roller 22 and the driven roller 23.

The transfer belt 21 rotates in a clockwise direction in FIG. 1 by the rotating drive of the drive roller 22. The transfer belt 21 thereby moves in an endless manner and transfers the paper sheet PA sucked and held on the paper-sheet holding surface 21*b* in the rightward direction.

The transfer belt 21 is wound around the drive roller 22 and the driven rollers 23 to 25. The drive roller 22 is rotationally driven by the belt drive motor 26 and rotates the transfer belt 21. The driven rollers 23 to 25 are driven by the drive roller 22 via the transfer belt 21. The driven roller 23 is arranged at substantially the same height as the drive roller 22 to be spaced away from the drive roller 22 at a predetermined interval in the left-right direction. The driven rollers 24, 25 are arranged at substantially the same height below the drive roller 22 and the driven roller 23 to be spaced away from each other at a predetermined interval in the left-right direction. The belt drive motor 26 rotationally drives the drive roller 22.

The platen plate 27 is arranged below the transfer belt 21 between the drive roller 22 and the driven roller 23 and slidably supports a lower surface of the transfer belt 21. In a portion where the belt holes 21*a* passes, the platen plate 27 has: multiple recessed portions 27*a* recessed from an upper surface toward a lower surface of the platen plate 27; and multiple sucking holes 27*b* each penetrating the platen plate 27 from a portion of a bottom surface of the corresponding recessed portion 27*a* to the lower surface of the platen plate 27.

The fan 28 generates a downward air flow. The fan 28 thereby sucks air through the sucking holes 27*b* and the recessed portions 27*a* of the platen plate 27 and the belt holes

21*a* of the transfer belt 21, generates a negative pressure in the belt holes 21*a*, and causes the paper sheet PA to adhere onto the paper-sheet holding surface 21*b*. The fan 28 is arranged below the platen plate 27.

The printing unit 4 performs printing on the paper sheet PA transferred by the transfer unit 3. The printing unit 4 is provided above the transfer unit 3. The printing unit 4 is fixed to a case (not illustrated) of the inkjet printing apparatus 1. The printing unit 4 includes inkjet heads 31C, 31K, 31M, 31Y, a head holder 32, and a head gap adjusting unit (head gap adjuster) 33. Note that alphabets (C, K, M, Y) attached to the reference numerals to indicate colors are omitted, for example, in a case where distinction of colors is unnecessary.

The inkjet heads 31C, 31K, 31M, 31Y respectively eject inks of cyan (C), black (K), magenta (M), and yellow (Y). The inkjet heads 31C, 31K, 31M, 31Y are arranged above the transfer unit 3 in the left-right direction parallel to each other. The inkjet heads 31C, 31K, 31M, 31Y are line inkjet heads and each include six head blocks 35 as shown in FIG. 4.

In each of the inkjet heads 31C, 31K, 31M, 31Y, the six head blocks 35 are arranged in a zigzag pattern. Specifically, the six head blocks 35 are arranged in the front-rear direction (main scanning direction MSD) in such a way that the positions thereof in the left-right direction (sub-scanning direction SSD) are alternately offset.

As shown in FIG. 1, the head holder 32 holds the head blocks 35 of the inkjet heads 31 above the transfer unit 3. The head holder 32 is formed in a substantially rectangular solid shape which is hollow.

As shown in FIGS. 4 and 5, each of the head blocks 35 is formed by bonding together a head module 36U and a head module 36D provided respectively on upstream (left) and downstream (right) sides in a transfer direction TD of the paper sheet PA.

As shown in FIG. 5, the head modules 36U, 36D respectively have nozzle arrays 37U, 37D in ejection surfaces 36*a* which are lower surfaces of the head modules 36U, 36D. Accordingly, each head block 35 has the two nozzle arrays 37U, 37D arranged in the left-right direction parallel to each other. Note that FIG. 5 is a view of the head block 35 from the lower side.

The nozzle arrays 37U, 37D eject the ink to dots which are on the same line in the sub-scanning direction SSD but are at different positions in the main scanning direction MSD. Specifically, the ink is ejected from the downstream nozzle array 37D to a certain line after the ink is ejected from the upstream nozzle array 37U to the certain line.

The nozzle arrays 37U, 37D each include multiple nozzles 38 arranged in the main scanning direction MSD (front-rear direction). In each of the nozzle arrays 37U, 37D, the nozzles 38 are arranged at equal intervals of a predetermined pitch P in the main scanning direction MSD. Moreover, the nozzles 38 in the nozzle array 37U and the nozzles 38 in the nozzle array 37D are arranged to be offset from one another by a half pitch (P/2) in the main scanning direction MSD. The resolution in the main scanning direction MSD is thereby improved.

In the head modules 36U, 36D, the number of droplets of the ink ejected to one pixel from one nozzle 38 can be changed to perform gradation printing in which density is expressed by the number of droplets (for example, one to seven droplets).

The head gap adjusting unit 33 adjusts the head gap H. As shown in FIG. 3, the head gap H is a distance between the paper-sheet holding surface 21*b* of the transfer belt 21 and the ejection surfaces 36*a* of the inkjet heads 31. The head gap adjusting unit 33 includes head gap adjusting mechanisms 41, a lifting motor 42, and a connecting member 43.

The head gap adjusting mechanisms 41 lift and lower the transfer unit 3 with respect to the inkjet head 31. Two head gap adjusting mechanisms 41 are provided to be spaced away from each other in the front-rear direction. Each head gap adjusting mechanism 41 includes a pair of pulleys 46, 47, a shaft 48, and wires 49, 50.

The pulleys 46, 47 take up and pay out the wires 49, 50, respectively. The pulleys 46, 47 are spaced away from each other in the left-right direction and are rotatably supported in the head holder 32.

The shaft 48 connects the pair of pulleys 46, 47 to each other. The shaft 48 is made of a long member extending in the left-right direction. One end of the shaft 48 is fixed to the pulley 46 and the other end is fixed to the pulley 47. The pair of pulleys 46, 47 are thereby synchronously rotated.

The wires 49, 50 support the transfer unit 3 in a suspended manner. One ends of the wires 49, 50 are connected to the transfer unit 3 and the other ends are wound around the pulleys 46, 47. When the wires 49, 50 are taken up or paid out by the rotation of the pulleys 46, 47, the transfer unit 3 is lifted or lowered and the head gap H changes.

The lifting motor 42 rotationally drives the pulleys 46, 47. The connecting member 43 is a member connecting the head holder 32 and the transfer unit 3 to each other. The connecting member 43 is configured such that the length in the up-down direction can be adjusted according to the head gap H.

The reader 6 has a feeding device for feeding a document and a reading device for reading a document image (both devices are not illustrated) and creates data of the document by reading the document set in a tray of the feeding device while transferring the document.

In the inkjet printing apparatus 1 in the embodiment which has the configuration described above, each of the inkjet heads 31C, 31K, 31M, 31Y of respective colors is formed by arranging the six head blocks 35 in the zigzag pattern. The controller 5 thus adjusts the ink ejection amounts in portions where the head blocks 35 overlap one another in the main scanning direction MSD, in such a way that dots corresponding to one line in the main scanning direction MSD are formed on the paper sheet PA by the ink ejected from the nozzles 38 in the six head blocks 35.

Figure 6:
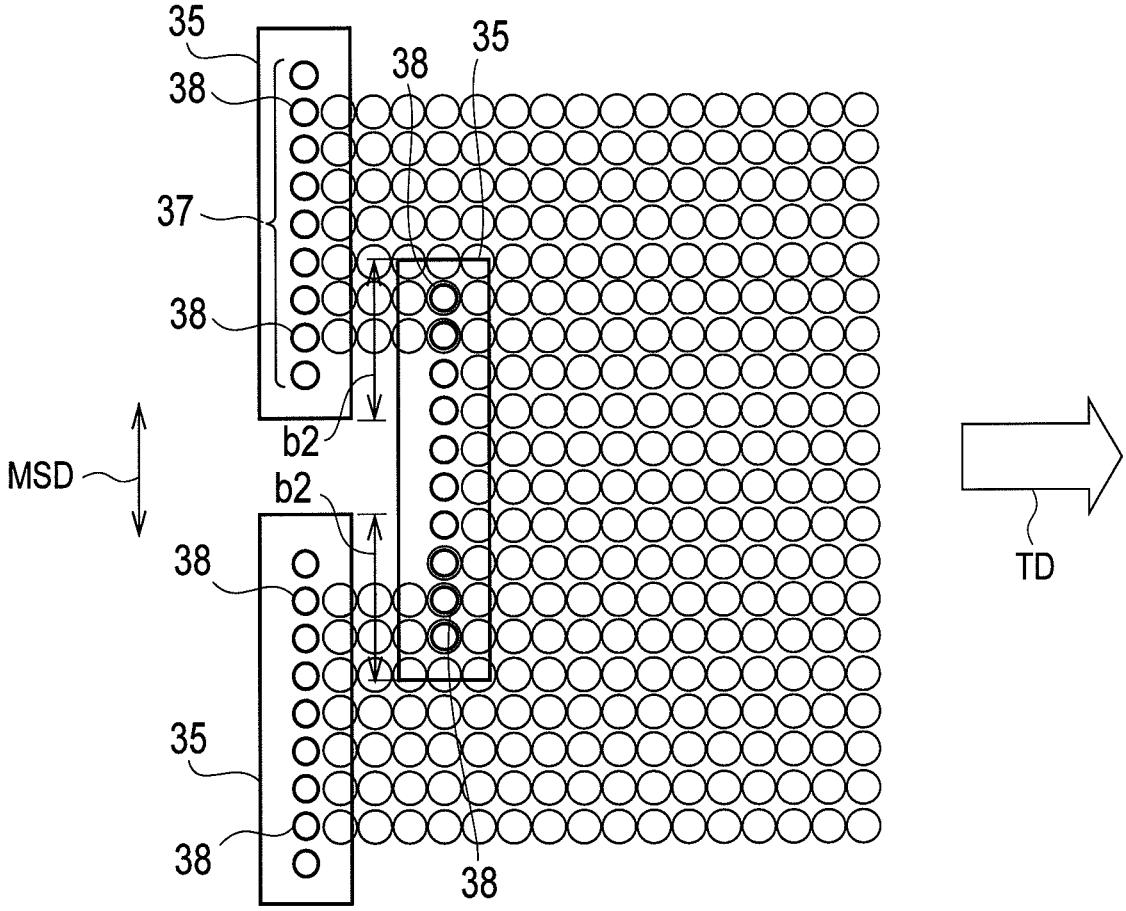
FIG. 6 is an explanatory diagram showing an arrangement of the head blocks having nozzles in seam portions and an image formed by the head blocks.
Figure 7:
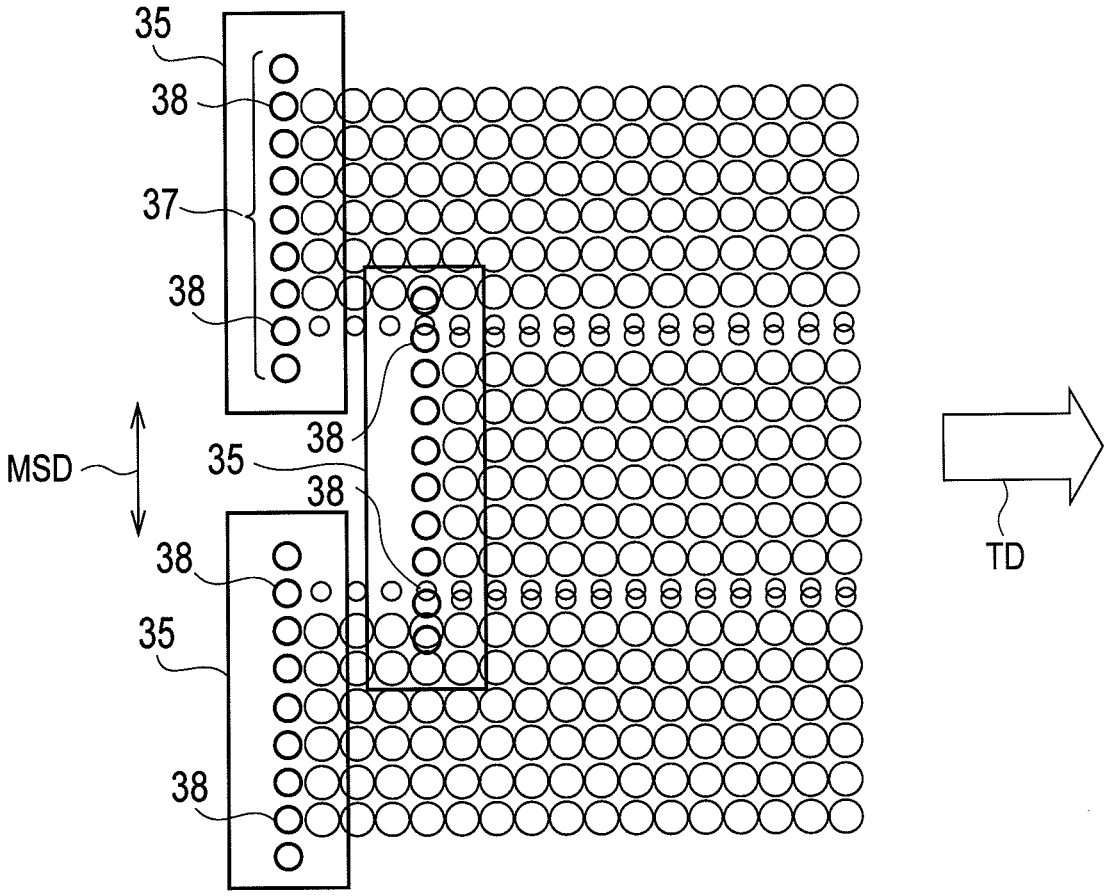
FIG. 7 is an explanatory diagram showing an image formed by the head blocks in a case where the positions of a pair of nozzles arranged in the seam portion are deviated.

Here, referring to FIGS. 6 and 7, description is given of contents of adjustment on the ink ejection amounts of the nozzles 38 which is performed by the controller 5 in the portions where the head blocks 35 overlap one another in the main scanning direction MSD. In FIGS. 6 and 7, in order to facilitate the viewing of the drawings, the nozzles 38 in each head block 35 are shown in a simplified manner to be arranged in one nozzle array 37.

First, as shown in FIG. 6, in overlapping portions of the head blocks 35 adjacent to each other in the main scanning direction MSD, that is in seam portions b2, the two adjacent head blocks 35 are supposed to be arranged with the positions of the nozzles 38 in the main scanning direction MSD aligned with one another. In this state, the ink is ejected from one nozzle 38 in a normal way while no ink is ejected from the other nozzle 38, so that the total of the ejection amounts of the two nozzles 38, 38 is equal to the normal ejection amount of one nozzle 38.

However, as shown in FIG. 7, in an actual case, the two adjacent head blocks 35, 35 are sometimes arranged in such a way that positions of the nozzles 38 in the main scanning direction MSD are offset from each other in the seam portion b2, due to offset within the tolerance. When the ink is ejected from each nozzle 38 in this state, the distance between a dot formed in this ink ejection and an adjacent dot may be short or long. A black stripe is formed when the dot distance is short while a white stripe is formed when the dot distance is long, and printing quality deteriorates in both cases.

To counter this, as shown in FIG. 7, the controller 5 adjusts the ink ejection amounts of the nozzles 38 located in the seam portion b2 in one or both of the head blocks 35, 35 (seam correction), and suppresses formation of the black stripe and the white stripe.

Figure 8:
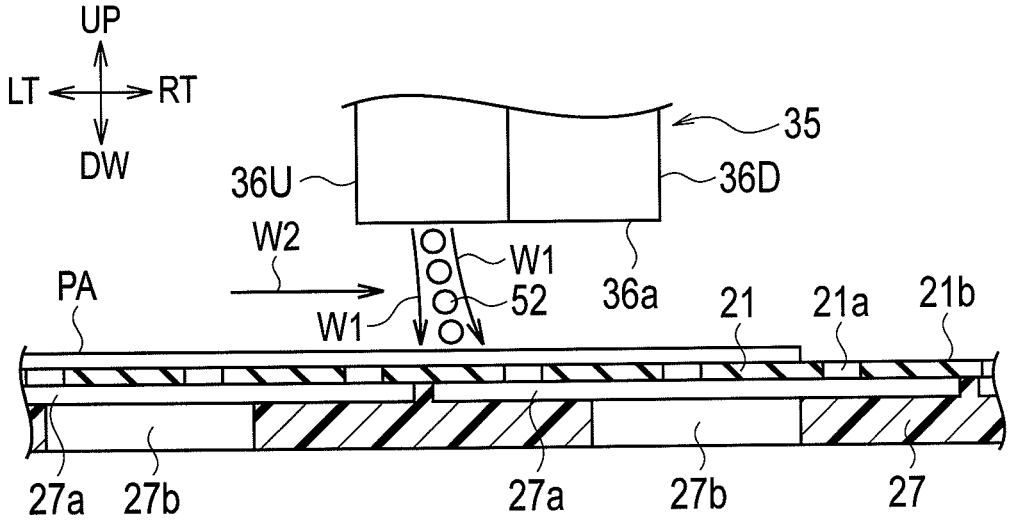
FIG. 8 is an explanatory diagram of a self-generated air flow generated in an upstream nozzle array in each of the head blocks in FIG. 1.

Moreover, in the printing by the inkjet printing apparatus 1 of the embodiment, as shown in FIG. 8, a self-generated air flow W1 flowing from the head block 35 of the inkjet head 31 to the paper sheet PA is generated due to the ejection of ink droplets 52 from the head block 35. Moreover, a transfer air flow W2 which is an air flow in the transfer direction TD is generated due to the transfer of the paper sheet PA by the transfer unit 3 and the suction of air by the fan 28.

The self-generated air flow W1 described above becomes stronger when the multiple nozzles 38 consecutive in the main scanning direction MSD are ejecting the ink. Moreover, the self-generated air flow W1 increases when the same nozzle 38 is repeatedly ejecting the ink to dots in multiple consecutive lines. Specifically, the degree of the self-generated air flow W1 generated due to the ejection of ink becomes stronger when there is a high-ejection-density region in which the density (ejection density) of the ink ejected by the nozzle 38 on the paper sheet PA per unit area is high.

When a self-generated air flow degree indicating the degree of the self-generated air flow W1 increases, the transfer air flow W2 generated due to the transfer of the paper sheet PA to flow from the upstream side to the downstream side in the transfer direction TD is blocked by the self-generated air flow W1.

Figure 9:
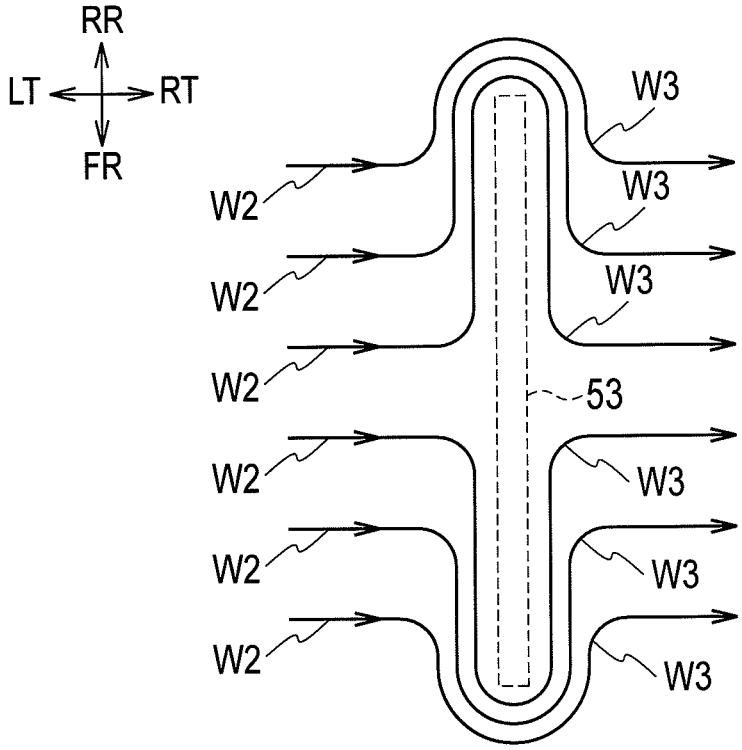
FIG. 9 is an explanatory diagram of air flows near an ink wall generated in each of the head blocks in FIG. 1.

In this case, as shown in FIG. 9, multiple streams of self-generated air flow W1 corresponding to the nozzles 38 and generated to be continuous in the main scanning direction MSD form an ink wall 53 blocking the transfer air flow W2. A bypassing air flow is generated due to the ink wall 53 at a degree corresponding to the self-generated air flow degree described above. The transfer air flow W2 thus changes to the bypassing air flow W3 which bypasses the self-generated air flow W1 and flows downstream in the transfer direction TD. Streams of the bypassing air flow W3 flow from both ends toward the center of the ink wall 53 in the main scanning direction MSD.

As shown in FIGS. 4 and 5, in the inkjet printing apparatus 1 of the embodiment, each of the head blocks 35 is provided with the head module 36U and the head module 36D respectively on the upstream and downstream sides in the transfer direction TD of the paper sheet PA. Accordingly, when the self-generated air flow W1 described above is generated between the upstream head module 36U and the paper sheet PA, the bypassing air flow W3 described above flows between the downstream head module 36D and the paper sheet PA in the main scanning direction MSD.

When such bypassing air flow W3 is generated in the downstream head module 36D, the ink droplets (see FIG. 8) ejected from the nozzles 38 in the nozzle array 37D of the head module 36D are swept away in the main scanning direction MSD by the bypassing air flow W3. The flying trajectories of the ink droplets ejected from the downstream nozzle array 37D are thus bent toward the center.

Figure 10:
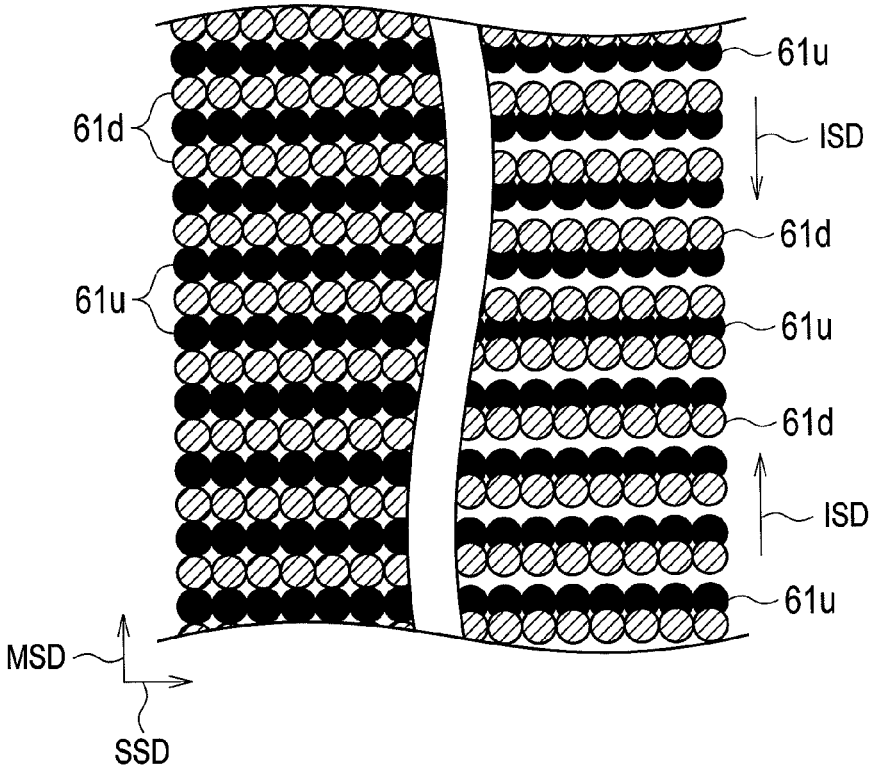
FIG. 10 is an explanatory diagram of landing deviation in a case where the ink wall is formed by ink ejection from the upstream nozzle array.

FIG. 10 shows a state where the ink is ejected from the multiple consecutive nozzles 38 to the lines in the high-ejection-density region formed by the upstream nozzle array 37U and landing deviation of the ink ejected from the downstream nozzle array 37D thereby occurs due to the ink wall 53. Note that, reference sign ISD in the drawings denotes a landing deviation direction.

As shown in FIG. 10, landed-ink dots 61*d* formed by the ink droplets ejected from the nozzles 38 in the downstream nozzle array 37D deviate from the ideal landing positions in the main scanning direction MSD. In this drawing, landed-ink dots 61*u* are landed-ink dots formed by the ink droplets ejected from the nozzles 38 in the upstream nozzle array 37U.

In a left region of FIG. 10 where the nozzles 38 have just started to eject the ink to dots in lines arranged in the sub-scanning direction SSD, since the self-generated air flow W1 does not stably exist yet, no ink wall 53 is formed and no bypassing air flow W3 is generated. Therefore, the landing deviation caused by the bypassing air flow W3 does not occur.

Figure 11:
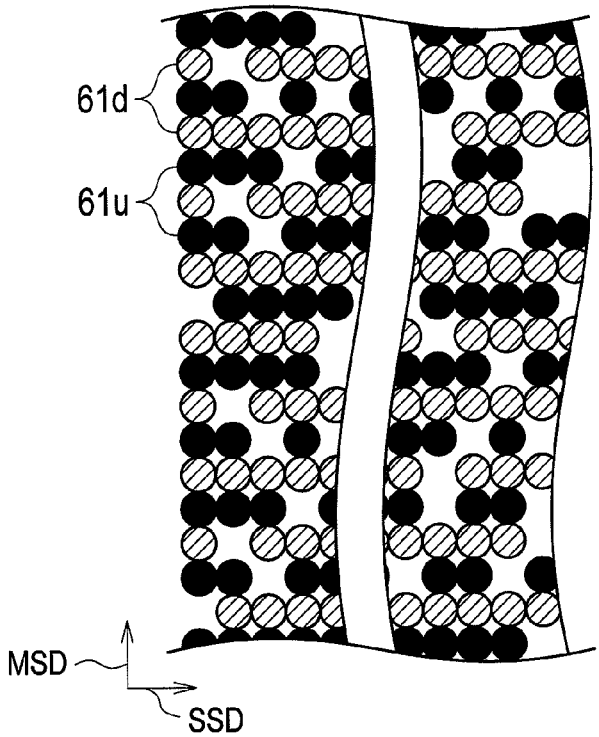
FIG. 11 is an explanatory diagram showing landed dots in a case where no ink wall is formed.

Moreover, in the upstream nozzle array 37U, when the ink is ejected only from some of the multiple nozzles 38 consecutive in the main scanning direction MSD and the density of the landed-ink dots 61*u* formed by the upstream nozzle array 37U is small as shown in FIG. 11, no ink wall 53 is formed because the self-generated air flow W1 is not stably generated. Therefore, the landing deviation of the landed-ink dots 61*d* formed by the downstream nozzle array 37D due to the ink wall 53 does not occur.

When all of the multiple nozzles 38 consecutive in the main scanning direction MSD eject ink and each of the nozzles 38 ejects the ink to dots in multiple lines consecutive in the sub-scanning direction SSD, thereby forming the high-ejection-density region on the paper sheet PA, the self-generated air flow degree of the self-generated air flow W1 increases and the bypassing air flow W3 of a significant degree is generated.

When the ink ejected from the nozzles 38 in the downstream nozzle array 37D lands to deviate in the main scanning direction MSD due to the generation of the bypassing air flow W3, suppression of the formation of the white stripe and the black stripe may become impossible even when the ink ejection amounts of the nozzles 38 in the seam portion b2 where the head blocks 35 adjacent to each other in the main scanning direction MSD overlap each other are adjusted in the seam correction described above with reference to FIG. 6.

To counter this problem, in the inkjet printing apparatus 1 of the embodiment, the controller 5 of FIG. 2 controls the ejection amounts of the ink droplets 52 ejected to the dots in the high-ejection-density region by the nozzles 38 located in the seam portion b2 in each of the downstream head modules 36D in FIG. 4 (see FIG. 6). This control can suppress the landing deviation caused by the bypassing air flow W3 shown in FIG. 9. A procedure of the control performed by the controller 5 is described later.

The controller 5 of FIG. 2 controls operations of various parts in the inkjet printing apparatus 1. The controller 5 includes a CPU, a RAM, a ROM, a hard disk, and the like.

The controller 5 stores a seam correction table in advance to adjust the ink ejection amounts from the nozzles 38 in the seam portion b2 (see FIG. 6) in which the head blocks 35 adjacent in the main scanning direction MSD overlap each other.

The seam correction table is a table in which a coefficient is used to set contents for correcting the amount of ink ejected from each of the nozzles 38 in the seam portion b2 of each head block 35. For example, when the ejection amount is set to be the same as the ejection amount before the correction, the correction coefficient is 1.

Here, the correction coefficient has the following meaning. When the correction coefficient is 1, a dot density after the correction is the same as the density before the correction. When the correction coefficient is larger than 1, the dot density after the correction is higher than the density before the correction. When the correction coefficient is smaller than 1, the dot density after the correction is lower than the density before the correction.

Figures 12A, 12B:
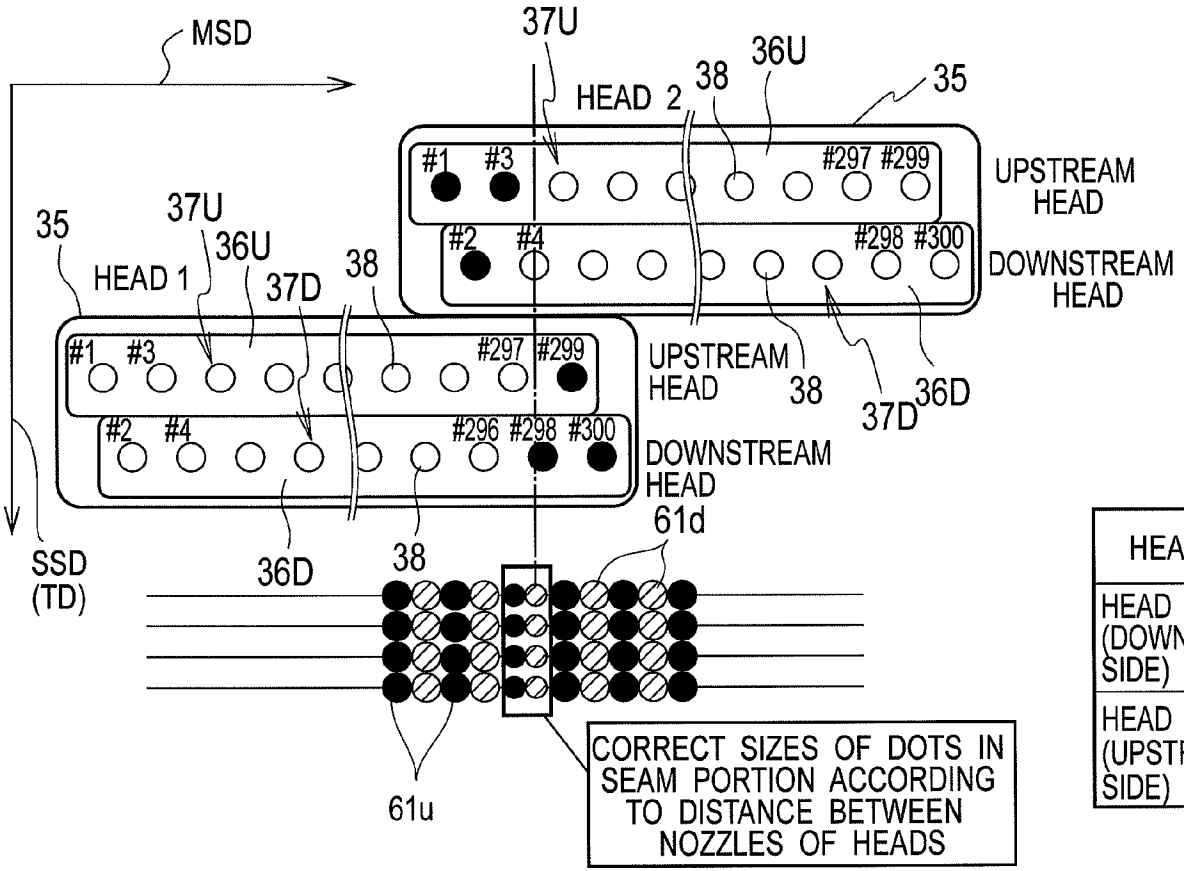
FIG. 12A is an explanatory diagram showing a relationship between a nozzle arrangement in the seam portion of the two head blocks and the ink ejection amounts of the nozzles.
FIG. 12B is an explanatory diagram showing an example of a seam correction table stored in a controller in FIG. 2 for the nozzles in the seam portion in FIG. 12A.

In the arrangement example shown in FIG. 12A, the head block 35 ("head 2" in FIG. 12A) and the head block 35 ("head 1" in FIG. 12A) respectively on the upstream and downstream side in the transfer direction TD each have the upstream head module 36U and the downstream head module 36D. Moreover, odd numbers are given to the nozzles 38 in the upstream head module 36U while even numbers are given to the nozzles 38 in the downstream head module 36D.

Moreover, in the example shown in FIG. 12A, the fourth (#4) nozzle 38 in the head block 35 on the upstream side in the transfer direction TD and the 297th (#297) nozzle 38 in the head block 35 on the downstream side in the transfer direction TD are nozzles which are targets of the ink ejection amount (sizes of dots) correction located in the seam portion b2 (see FIG. 6). The correction contents of the seam correction table stored in, for example, the hard disk of controller 5 are used for these nozzles 38 which are correction targets.

In the example of the seam correction table shown in FIG. 12B (configuration example of correction values for correcting uneven density in the seam portions), the correction coefficient of 0.5 is set for both of the fourth (#4) nozzle 38 in the upstream head block 35 and the 297th (#297) nozzle 38 in the downstream head block 35.

In the arrangement example shown in FIG. 12A, for each of the first to third (#1 to #3) nozzles 38 in the upstream head block 35 and the 298th to 300th (#298 to #300) nozzles 38 in the downstream head block 35, a nozzle which overlaps the each nozzle in the main scanning direction MSD exists in the opposing head block 35 overlapping the each nozzle in the seam portion b2. Control is thus performed such that the ink is not ejected from both of the nozzles.

Moreover, the controller 5 of FIG. 2 stores a bypassing air flow correction table in advance to adjust the ejection amounts of the ink droplets 52 ejected to the dots in the high-ejection-density region by the nozzles 38 located in the seam portion b2 in the downstream head module 36D (see FIG. 6).

The bypassing air flow correction table is a table in which correction contents to be added to the correction contents of the ink ejection amount set in the aforementioned seam correction table are set according to an ink ejection density determining the self-generated air flow degree affecting a generation degree of the bypassing air flow W3, so that the correction contents of the bypassing air flow correction table can be set according to the generation degree of the bypassing air flow W3.

The ink ejection density can be expressed by, for example, a coverage rate indicating an area ratio of a region in which the printing is actually performed to a printable region in the paper sheet PA. Moreover, the coverage ratio can be defined in a one-dimensional or two-dimensional range by using one or both of the number of ink-ejected dots consecutive in the main scanning direction MSD and the number of ink-ejected dots consecutive in the sub-scanning direction SSD.

The controller 5 in the embodiment stores and uses the bypassing air flow correction table in which the correction contents of the ink ejection amount to be added to the correction contents set in the seam correction table are set to be classified according to the coverage ratio defined in the two-dimensional range by using the numbers of ink-ejected dots consecutive in the main scanning direction and the sub-scanning direction.

The self-generated air flow degree which is a generation factor of the bypassing air flow W3 and which is determined by the ink ejection density increases also when the ejection of ink is repeated by the same nozzle 38 to the same dot. Accordingly, the correction contents set in the seam correction table can be classified according to the ink ejection density (coverage ratio) additionally including the number of ink droplets ejected by the same nozzle 38 to the same dot.

Figures 13A, 13B:
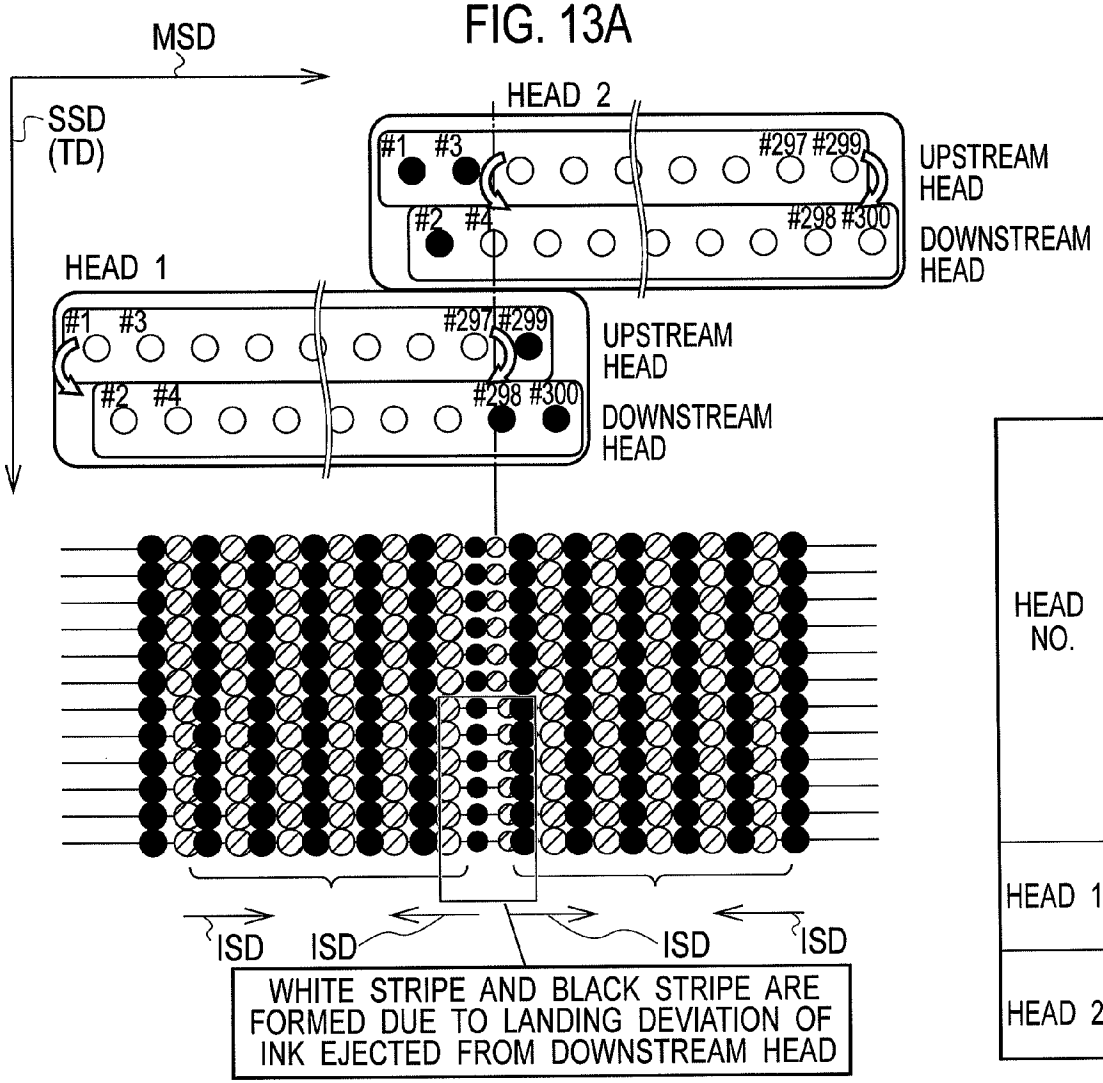
FIG. 13A is an explanatory diagram showing landing deviation caused by a bypassing air flow generated by ejection of the ink from the nozzles in the nozzles arrays of the two head blocks in FIG. 12A.
FIG. 13B is an explanatory diagram showing an example of a bypassing air flow correction table stored in the controller in FIG. 2 to correct the landing deviation caused by the bypassing air flow in FIG. 13A.

In the arrangement example shown in FIG. 13A, the ink ejected by the downstream head module 36D in each of the upstream head block 35 ("head 2" in FIG. 13A) and the downstream head block 35 ("head 1" in FIG. 13A) is swept away by the bypassing air flow W3 toward the center of the head block 35 in the main scanning direction MSD and the landing deviation of the ink occurs.

Particularly, the landing deviation of the ink ejected from the 297th (#297) nozzle 38 in the downstream head block 35 is larger than the landing deviation of the ink ejected from the other nozzles 38, the 297th (#297) nozzle 38 being a nozzle whose ink ejection amount is corrected to be a half of the normal amount by the correction contents (correction coefficient=0.5) of the seam correction table in FIG. 12B described above.

The landing deviation increases a margin between the ink ejected from the 297th (#297) nozzle 38 and the ink ejected from the fourth (#4) nozzle 38 in the upstream head block 35 whose ink ejection amount is similarly corrected to be a half of the normal amount by the seam correction. In this state, the white stripe which is supposed to be eliminated by the seam correction is formed. To counter this, the correction contents of the bypassing air flow correction table stored in, for example, the hard disk of the controller 5 are applied to the fourth (#4) nozzle 38 in the upstream head block 35 and the 297th (#297) nozzle 38 in the downstream head block 35 which are targets of the seam correction.

In the example of the bypassing air flow correction table shown in FIG. 13B, the correction contents classified into three groups according to the coverage ratio are set for the fourth (#4) nozzle 38 in the upstream head block 35 and the 297th (#297) nozzle 38 in the downstream head block 35. Specifically, a correction coefficient 0 is set as the additional correction contents for the coverage ratio "to 0.5 (smaller than 0.5)". Similarly, a correction coefficient +0.25 is set as the additional correction contents for the coverage ratio "0.5 to 0.7 (equal to or larger than 0.5 and smaller than 0.7)", and a correction coefficient +0.5 is set as the additional correction contents for the coverage ratio "0.7 to 1.0 (equal to or larger than 0.7 and equal to or lower than 1.0)". When the ink is consecutively ejected from all of the nozzles near the seam, the coverage ratio near the seam is density 1.

In a case where the correction contents which are applied to the target nozzles 38 by using the bypassing air flow table every time the ink is ejected from the nozzles 38 are determined depending on the coverage ratio which is an index of application, the coverage ratio of the nozzles 38 can be determined as follows, for example.

Specifically, the coverage ratio can be determined based on the ejection pattern (the main scanning direction MSD, the sub-scanning direction SSD, the same dot) of the ink ejected to the dots in past predetermined lines (for example, 30 lines) by the correction target nozzle 38 in the downstream head module 36D and the nozzle 38 in the upstream head module 36U adjacent to the correction target nozzle 38 in the main scanning direction MSD in each of the upstream and downstream head blocks 35. The nozzles 38 whose ejection patterns of the ink are to be referenced to determine the coverage ratio can be increased in the main scanning direction MSD, as a matter of course.

Moreover, the correction contents of each group classified according to the coverage ratio can be determined as follows. For example, the degree of landing deviation of the ink in the main scanning direction MSD due to the bypassing air flow W3 is grasped from a test pattern provided for each level of coverage ratio (ink ejection density) which is printed by the inkjet printing apparatus 1, and the correction contents are determined based on the grasped degree. For example, as shown in the explanatory diagrams of FIGS. 14A to 14C, the used test patterns can be images of three patterns in which ejection dot densities in both of the main scanning direction MSD and the sub-scanning direction SSD are high (FIG. 14A), intermediate (FIG. 14B), and low (FIG. 14C) for each color.

Next, description is given of operations performed by the inkjet printing apparatus 1 to determine the correction contents of the bypassing air flow correction table in FIG. 13B.

Figure 14A:
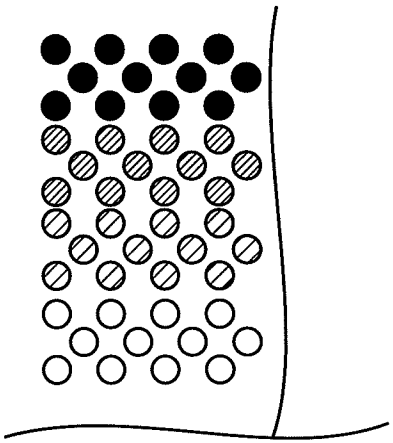
FIGS. 14A to 14C are explanatory diagrams each showing an example of a test pattern used to determine correction contents of the bypassing air flow correction table in FIG. 13B.
Figure 14A:
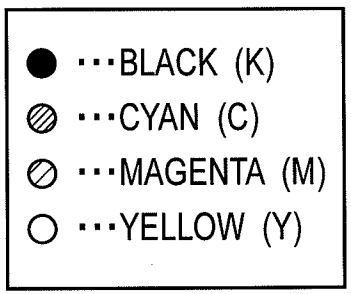
Figure 14B:
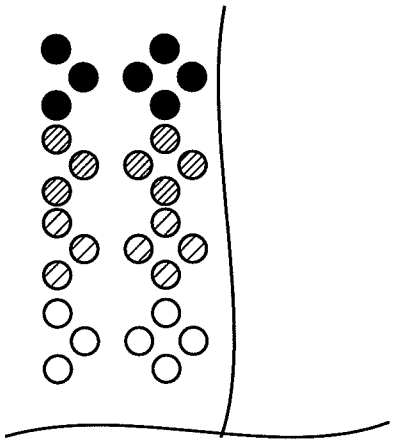
Figure 14B:
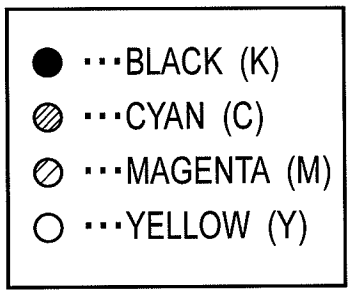
Figure 14C:
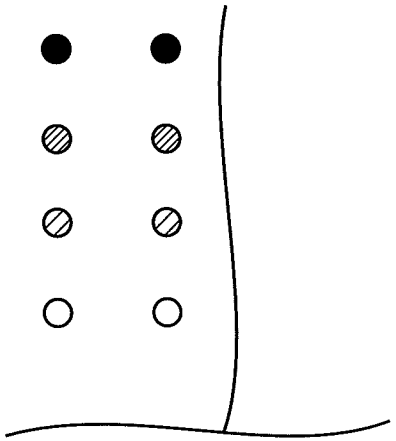
Figure 14C:
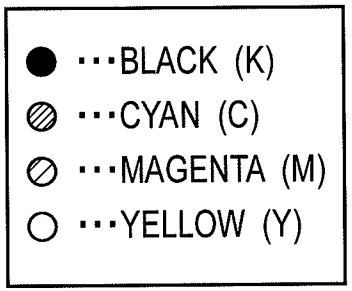
Figure 15:
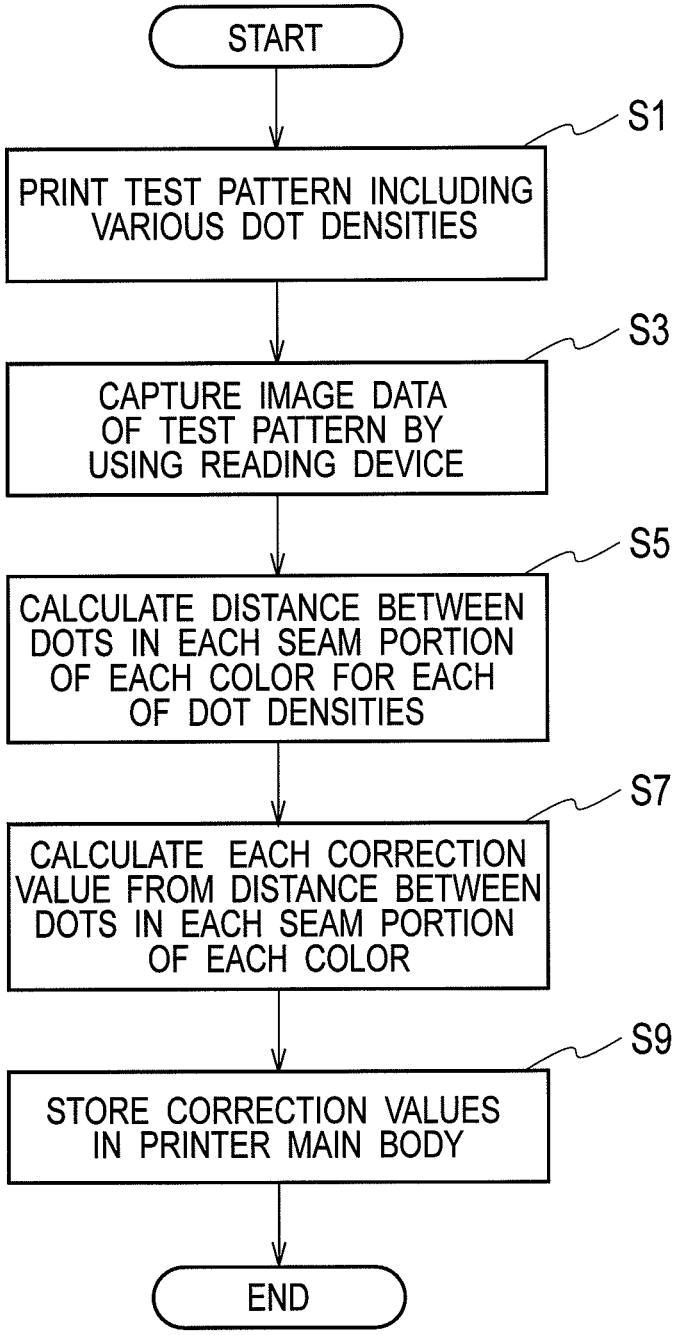
FIG. 15 is a flowchart for explaining operations performed by the inkjet printing apparatus to determine the correction contents of the bypassing air flow correction table in FIG. 13B.

FIG. 15 is a flowchart for explaining the operations performed by the inkjet printing apparatus 1 when the correction contents of the bypassing air flow correction table are determined. The processing of the flowchart of FIG. 15 starts when image data of the test patterns in FIGS. 14A to 14C is inputted to the inkjet printing apparatus 1.

In step S1 of FIG. 15, the controller 5 prints, by using the printing unit 4, the test patterns (including image portions of high, intermediate, and low dot density) read from, for example, the hard disk. At this time, the controller 5 performs the seam correction of the ink ejection amounts of the nozzles 38 in the seam portions b2 (see FIG. 6) of the head blocks 35 of each color, by using the seam correction table in FIG. 12B stored in the hard disk in advance.

After the test patterns are printed on the paper sheet PA, the reading device of the reader 6 reads and captures the test pattern images on the printed paper sheet PA (step S3). Then, the controller 5 uses the captured test pattern images to calculate, for each level of dot density, the distance between the dots formed by the ink ejected by the nozzles 38 in the seam portions b2 (see FIG. 6) of the head blocks 35 of each color (step S5).

Then, the controller 5 uses the calculated distance between dots to calculate the correction contents of the bypassing air flow correction table for each level of dot density (i.e. for each level of coverage ratio, that is, for each level of ink ejection density) of each color (step S7). The calculated correction contents are stored in the hard disk or the like as the bypassing air flow correction table (step S9) and the processing is then terminated.

In the processing described above, the correction contents of the bypassing air flow correction table can be determined in such a way that a user manually performs the processing after the printing of the test patterns by performing various input operations on the inkjet printing apparatus 1 while viewing the print result of the test patterns.

Next, description is given of operations performed by the inkjet printing apparatus 1 to correct the ink ejection amounts of the nozzles 38 in the seam portions by applying the correction contents of the bypassing air flow correction table in FIG. 13B.

Figure 16:
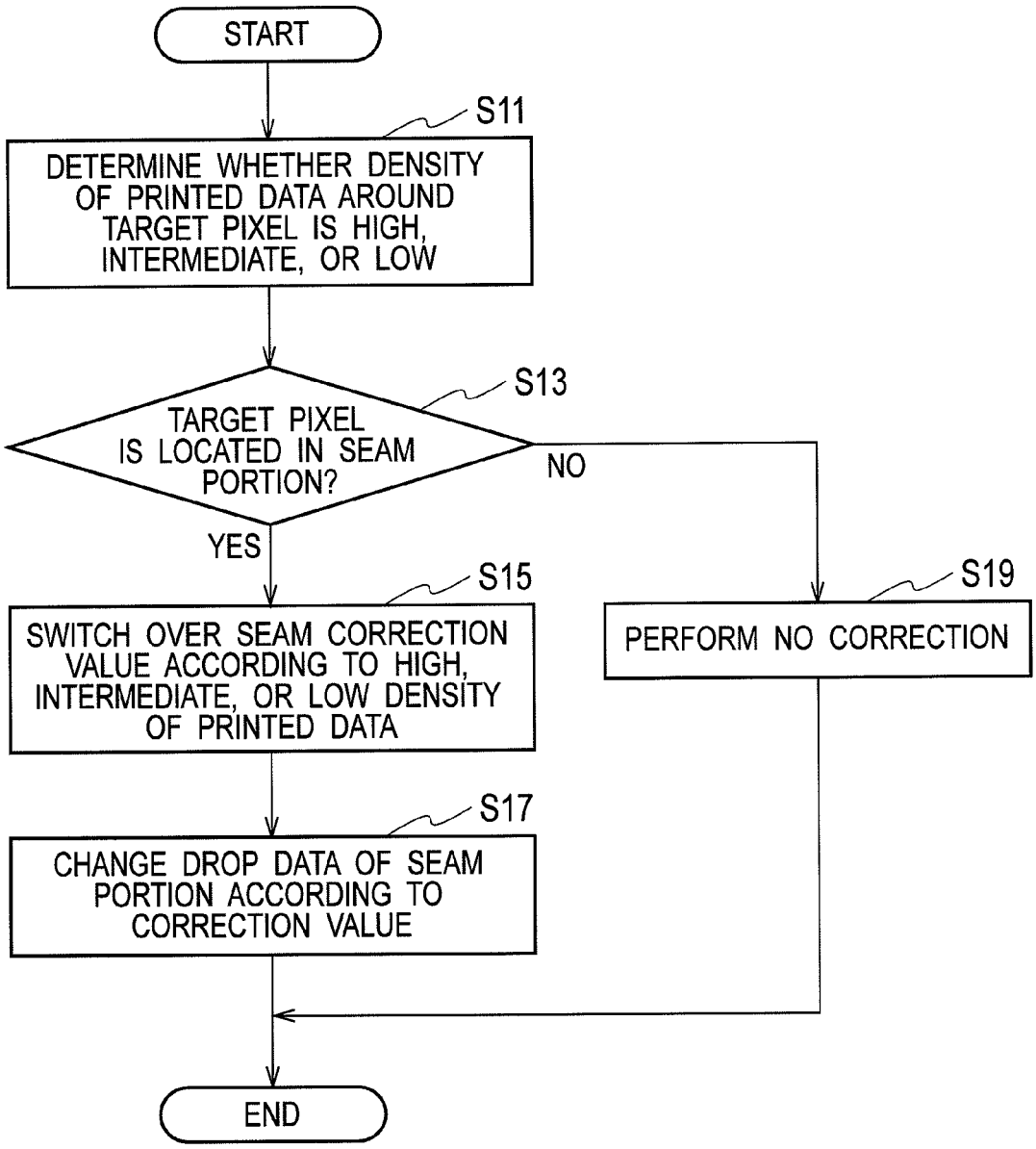
FIG. 16 is a flowchart for explaining operations performed by the inkjet printing apparatus to correct the ink ejection amounts of the nozzles in the seam portions by using the correction contents of the seam correction table in FIG. 12B and the correction contents of the bypassing air flow correction table in FIG. 13B.

FIG. 16 is a flowchart for explaining the operations performed by the inkjet printing apparatus 1 to correct the ink ejection amounts of the nozzles in the seam portions by using the correction contents of the bypassing air flow correction table. The processing of the flowchart of FIG. 16 starts when image data of a printing target is inputted to the inkjet printing apparatus 1 and droplet data which is image data of a format corresponding to the printing by the inkjet heads 31 is generated by the controller 5 from image data of a RGB format.

In step S11 of FIG. 16, for each color, assuming that each pixel in the droplet data is set to be a target pixel, the controller 5 determines to which one of the high, intermediate, and low levels does the dot density of the target pixel belongs, by using the droplet data of the target pixel and nearby pixels (pixels on both sides in the main scanning direction MSD and on the upstream side in the sub-scanning direction SSD).

Next, the controller 5 checks whether the nozzle 38 ejecting ink to the target pixel is the nozzle 38 located in the seam portion b2 (see FIG. 6) in the downstream head module 36D (step S13). When the nozzle 38 is the nozzle 38 in the seam portion b2 (YES in step S13), the correction contents for the seam correction for the ink ejection amount of this nozzle 38 is switched over (step S15).

Specifically, the controller 5 determines, by using the bypassing air flow correction table in FIG. 13B, the correction contents corresponding to the dot density (high, intermediate, and low), i.e. coverage ratio, determined in step S11, of the target pixel to which the ink is ejected by the nozzle 38 in the seam portion b2. Then, the contents of the seam correction performed by the controller 5 on the ink ejection amount of the nozzle 38 corresponding to the target pixel is switched from the contents set in the seam correction table shown in FIG. 12B to contents to which the determined correction contents are added.

The controller 5 thus adjusts and controls the ink ejection amount of the nozzle 38 in the seam portion b2, according to the switched correction contents, by changing the droplet data (step S17), and the processing is terminated.

When the nozzle 38 ejecting ink to the target pixel is not the nozzle 38 located in the seam portion b2 (see FIG. 6) in the downstream head module 36D (NO in step S13), no correction is performed on the ink ejection amount of this nozzle 38 (step S19) and the processing is terminated.

As is apparent from the aforementioned description, a seam correction portion is formed of the controller 5 in the embodiment.

Hence, it is possible to suppress a case where the ink which is ejected from the nozzles 38 in the seam portion b2 and whose ejection amount is controlled in the seam correction is swept away in the main scanning direction MSD by the bypassing air flow W3 and the landing deviation of the ink occurs as shown in FIG. 13A. Accordingly, the ink-landing state becomes similar to the ink-landing state shown in FIG. 7 where no landing deviation in the main scanning direction MSD is caused by the bypassing air flow W3, and the image forming apparatus 1 can form an excellent image in which the white stripe and the black stripe are suppressed.

Incidentally, the landing deviation amount increases as the distance between the paper sheet PA and the ejection surface 36*a* increases. The distance between the paper sheet PA and each of the ejection surfaces 36*a* is equal to a distance obtained by subtracting the thickness of the paper sheet PA from the head gap H. In a case where the paper sheets PA are of the same kind (have the same thickness), the distance between each paper sheet PA and the ejection surface 36*a* increases as the head gap H increases.

However, for example, in a case where multiple kinds of paper sheets PA whose thicknesses are different mixedly exist in the paper sheets PA to be used for printing, the head gap H is maintained in a dimension corresponding to the thickness of the thick paper sheet PA. Thus, when the thin paper sheet PA passes a position directly below the ejection surface 36*a*, the distance between the paper sheet PA and the ejection surface 36*a* increases in some cases.

Figure 17A:
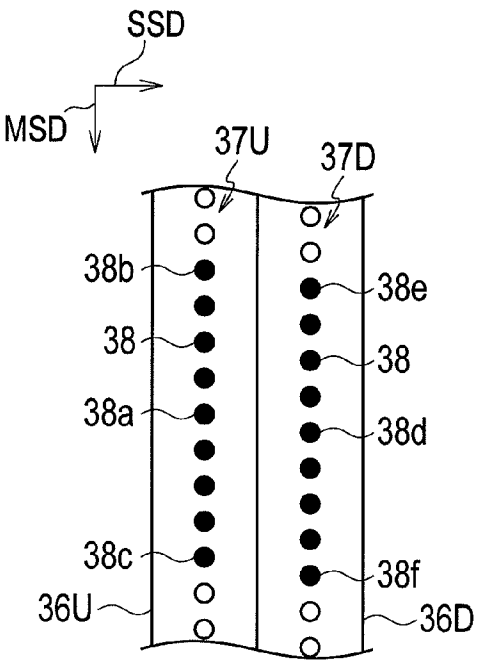
FIG. 17A is an explanatory diagram showing the nozzles ejecting the ink in an experiment showing a relationship between a landing deviation amount and the distance between a paper sheet and an ejection surface.
Figure 17B:
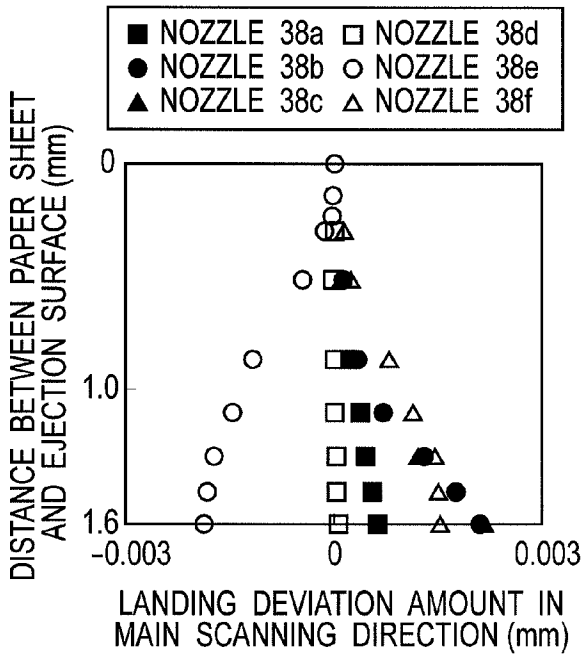
FIG. 17B is an explanatory diagram showing a relationship between the landing deviation amount in a main scanning direction and the distance between the paper sheet and the ejection surface in the experiment.
Figure 17C:
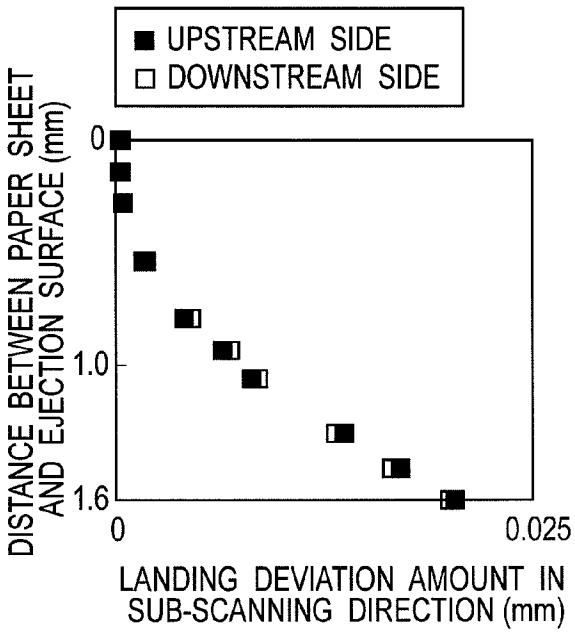
FIG. 17C is an explanatory diagram showing a relationship between the landing deviation amount in a sub scanning direction and the distance between the paper sheet and the ejection surface in the experiment.

FIGS. 17A to 17C show the experiment results showing a relationship between the landing deviation amount and the distance between the paper sheet PA and the ejection surface 36*a*. In FIG. 17A, the multiple adjacent nozzles 38 having ejected the ink in this experiment are shown by being blacked out. Moreover, FIG. 17B shows a relationship between the landing deviation amount in the main scanning direction MSD in each of the nozzles 38*a*, 38*b*, 38*c* of the upstream nozzle array 37U and the distance between the paper sheet PA and the ejection surface 36*a*, and a relationship between the landing deviation amount in the main scanning direction MSD in each of the nozzles 38*d*, 38*e*, 38*f* of the downstream nozzle array 37D and the distance between the paper sheet PA and the ejection surface 36*a*.

The nozzle 38*a* is the nozzle 38 in a center portion among the multiple nozzles 38 having ejected the ink in the upstream nozzle array 37U while the nozzles 38*b*, 38*c* are the nozzles 38 at both ends among the multiple nozzles 38. The nozzle 38*d* is the nozzle 38 in a center portion among the multiple nozzles 38 having ejected the ink in the downstream nozzle array 37D while the nozzles 38*e*, 38*f* are the nozzles 38 at both ends among the multiple nozzles 38. The landing deviation amounts shown in FIG. 17B are landing deviation amounts in the main scanning direction MSD in a constant state where the ink wall 53 is formed by the ink ejection from the upstream nozzle array 37U.

As shown in FIG. 17B, in the nozzle 38*e* and the nozzle 38*f* in the downstream nozzle array 37D, the landing deviation toward the center side in directions opposite from each other is confirmed. Moreover, the landing deviation amount increases as the distance between the paper sheet PA and the ejection surface 36*a* increases.

FIG. 17C shows a relationship between an average value of the landing deviation amount of each nozzle 38 in the upstream nozzle array 37U in the sub-scanning direction SSD in the constant state where the ink wall 53 is formed and the distance between the paper sheet PA and the ejection surface 36*a*, and a relationship between an average value of the landing deviation amount of each nozzle 38 in the downstream nozzle array 37D in the sub-scanning direction SSD and the distance between the paper sheet PA and the ejection surface 36*a*.

As shown in FIG. 17C, the landing deviation amount in the sub-scanning direction SSD is almost the same in the upstream nozzle array 37U and the downstream nozzle array 37D. Hence, it is conceivable that the bypassing air flow W3 does not affect the ink droplets 52 in such a way as to change the landing deviation amount of the ink in the sub-scanning direction SSD.

Thus, the correction contents of the ink ejection amounts set in the bypassing air flow correction table in FIG. 13B can be classified according to the size of the head gap H and be set in such a way that (the correction coefficients of) the correction contents to be added to the correction contents for the seam correction increase as the head gap H increases.

Moreover, the bypassing air flow W3 passing between the paper sheet PA and the ejection surface 36*a* in the downstream head module 36D of each head block 35 becomes stronger as the speed of the transfer air flow W2 increases. Since the speed of the transfer air flow W2 increases as the transfer speed of the paper sheet PA by the transfer unit 3 increases, the correction contents of the ink ejection amounts set in the bypassing air flow correction table in FIG. 13B can be further classified according to the transfer speed of the paper sheet PA by the transfer unit 3 and set in such a way that (the correction coefficients of) the correction contents to be added to the correction contents for the seam correction increase as the transport speed increases.

Second Embodiment

Next, description is given of an inkjet printing apparatus in a second embodiment of the present invention. Note that the structure of the inkjet printing apparatus in the second embodiment is the same as that of the inkjet printing apparatus 1 in the first embodiment.

The inkjet printing apparatus 1 in the first embodiment additionally corrects the correction contents of the ink ejection amounts for the seam correction, according to the landing deviation amounts of the ink in the main scanning direction MSD due to the bypassing air flow W3, the correction contents set for the nozzles 38 in the downstream head modules 36D which are located in the seam portion b2 (see FIG. 6) of the adjacent two head blocks 35.

On the other hand, the inkjet printing apparatus 1 of the second embodiment additionally corrects correction contents of ink ejection amounts for eliminating uneven density on a paper sheet PA, according to landing deviation amounts of ink in a main scanning direction MSD due to a bypassing air flow W3, the correction contents set for nozzles 38 in each downstream head module 36D which are arranged in end portions in the main scanning direction MSD.

Description is given below of how the density becomes uneven on the paper sheet PA by the ink ejected from the nozzles 38 in each downstream head module 36D which are disposed in the end portions in the main scanning direction MSD.

The nozzles 38 and multiple ink chambers (not illustrated) communicating with the nozzles 38 are provided inside an upstream head module 36U and the downstream head module 36D of each of head blocks 35. A controller 5 performs control to change the capacity of each ink chamber and the ink in the ink chamber is thereby ejected from the corresponding nozzle.

In such shear-mode head modules 36U, 36D, vibrations caused in the ink chambers close to the center in the main scanning direction MSD due to the change in the capacities are transmitted to the ink chambers close to the ends in the main scanning direction MSD. Here the ink chamber closer to any one of the ends in the main scanning direction MSD accumulates a larger amount of vibrations transmitted from the other ink chambers, which affects the ink ejection amount characteristics more significantly.

Figures 18A, 18B:
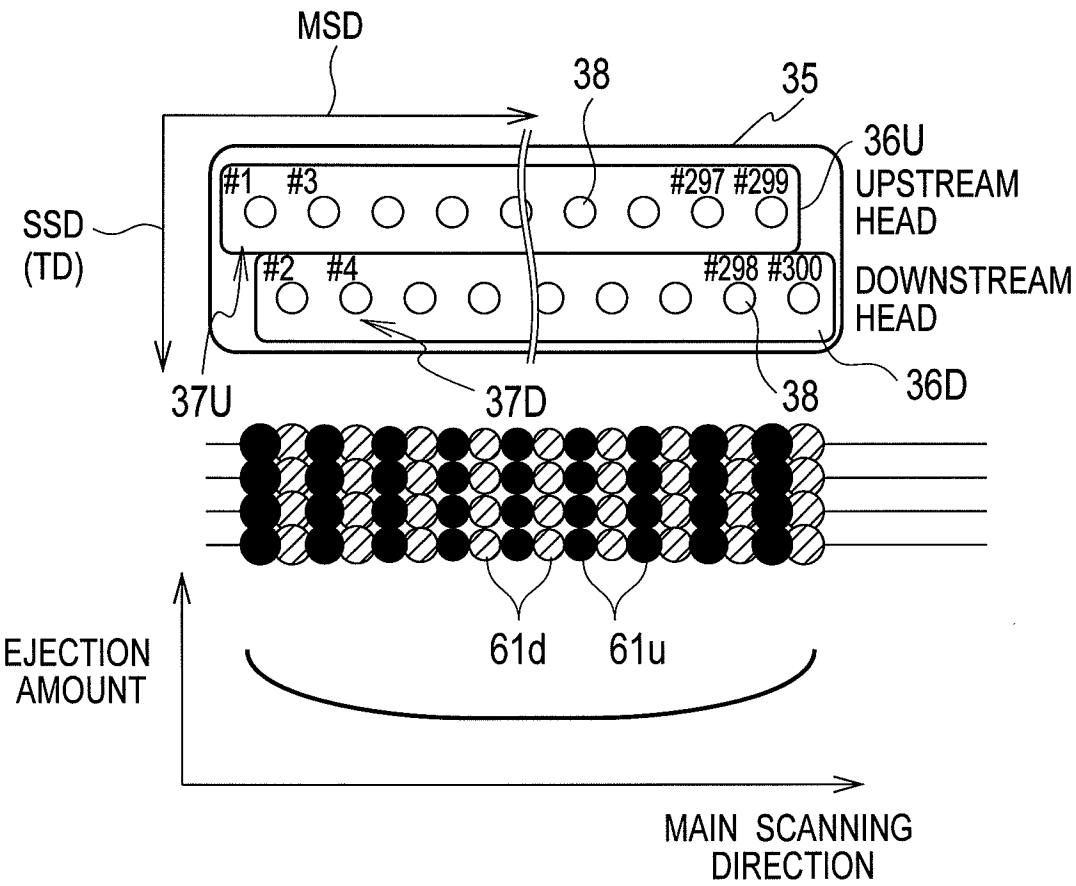
FIG. 18A is an explanatory diagram showing a relationship between a nozzle arrangement and ink ejection amounts of nozzles in a head block of an inkjet printing apparatus in a second embodiment of the present invention.
FIG. 18B is an explanatory diagram showing an example of an arrangement-based correction table stored in the controller of FIG. 2 for the nozzles in FIG. 18A.

In the arrangement example shown in FIG. 18A, the diameter of a dot formed by ejecting ink of the same amount from each of the nozzles 38 in the upstream head module 36U and the downstream head module 36D becomes larger from the center toward the ends in the main scanning direction MSD (i.e. the ejection amounts in both end portions in the main scanning direction MSD are large). This causes uneven density in which the concentration of the image is higher than the surrounding portions.

This is a phenomenon which occurs due to the following reason. The vibrations generated due to the change in the capacities of the not-illustrated ink chambers are sequentially transmitted from the center to the ends in the main scanning direction MSD. The transmitted vibrations cause a capacity change larger than the capacity change corresponding to the actual ink ejection amount in each of the ink chambers closer to the far ends and the ink ejection amount increases as shown in the graph of the drawing.

In order to prevent the occurrence of uneven density due to the accumulated vibrations transmitted from the other ink chambers, the controller 5 corrects the ink ejection amount of each of the nozzles 38 in the upstream head module 36U and the downstream head module 36D by using correction contents in an arrangement-based correction table stored in, for example, a hard disk which are set according to the arrangement of the nozzles 38 in the main scanning direction MSD.

In the example of the arrangement-based correction table shown in FIG. 18B, correction coefficients are set for the five nozzles 38 in each of the end portions of the head blocks 35 in the main scanning direction MSD. The correction coefficient of 0.9 is set for both of the first (#1) nozzle 38 on the upstream side and the 300th (#300) nozzle 38 on the downstream side in the far end portions where the ink ejection amount increases most. Moreover, the correction coefficients of 0.92 to 0.97 which become smaller toward the ends in the main scanning direction MSD are set for the other nozzles 38 (#2 to #5 and #296 to #299).

In the correction by the controller 5 which uses the correction contents set in the aforementioned arrangement-based correction table, no consideration is made of a bypassing air flow generated in the downstream head module 36D by a self-generated air flow W1 and a transfer air flow W2, the self-generated air flow W1 generated by ejection of the ink by the nozzles 38 in the upstream head module 36U, the transfer air flow W2 generated by transport of a paper sheet PA by a transfer unit 3.

Hence, the controller 5 further corrects the correction contents set in the arrangement-based correction table on the basis of a generation degree of the bypassing air flow W3, i.e. a coverage ratio (dot density on the paper sheet PA) of the nozzles 38 in the downstream head module 36D. The controller 5 stores a bypassing air flow correction table in advance to perform this correction.

The bypassing air flow correction table is a table in which correction contents to be added to the correction contents of the ink ejection amounts set in the aforementioned arrangement-based correction table are set according to the generation degree of the bypassing air flow W3. Note that, also in the bypassing air flow correction table of the embodiment, the correction contents of the ink ejection amount are set to be classified by using the coverage ratio as the ink ejection density determining a self-generated air flow degree affecting the generation degree of the bypassing air flow W3.

As in the first embodiment, the coverage ratio can be defined in a two-dimensional range by using the number of ink-ejected dots consecutive in the main scanning direction MSD and the number of ink-ejected dots consecutive in the sub-scanning direction SSD. However, the coverage ratio can be defined in a one-dimensional range by using only one of the numbers. Moreover, the correction contents set in a seam correction table can be classified according to an ink ejection density (coverage ratio) additionally including the number of ink droplets ejected by the same nozzle 38 to the same dot.

Figures 19A, 19B:
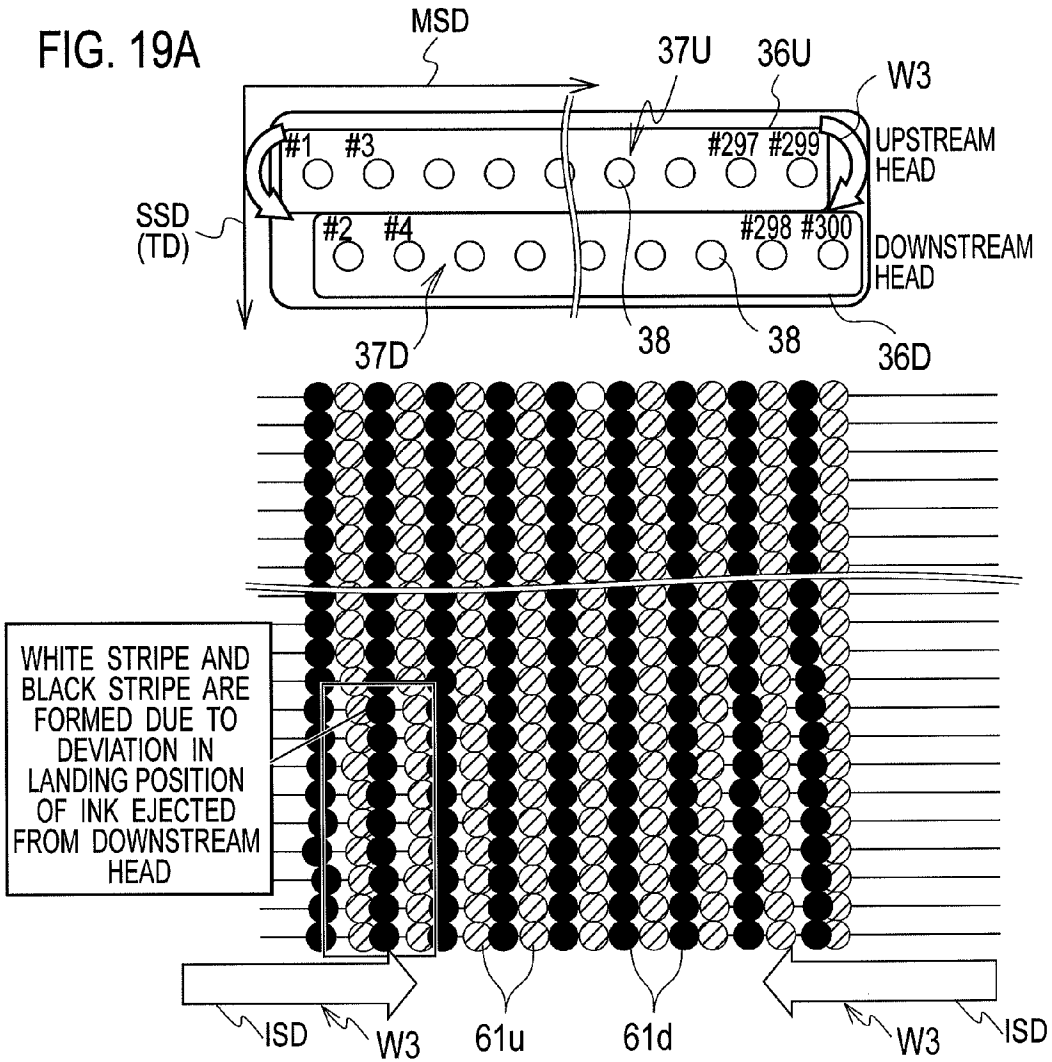
FIG. 19A is an explanatory diagram showing landing deviation caused by a bypassing air flow generated by ejection of ink from the nozzles in nozzles arrays of the head block in the inkjet printing apparatus in the second embodiment of the present invention.
FIG. 19B is an explanatory diagram showing an example of a bypassing air flow correction table stored in the controller in FIG. 2 to correct the landing deviation caused by the bypassing air flow in FIG. 19A.

In the arrangement example shown in FIG. 19A, the ink ejected by the downstream head module 36D is swept away toward the center of the head block 35 in the main scanning direction MSD by the bypassing air flow W3 and the landing deviation of the ink occurs.

Due to this landing deviation, an interval between droplets of ink ejected from adjacent nozzles 38 in the upstream head block 35 becomes more uneven toward both ends in the main scanning direction MSD. If this is left as it is, a black stripe and a white stripe are alternately formed. To counter this, the correction contents of the bypassing air flow correction table stored in, for example, the hard disk of the controller 5 are applied to the nozzles 38 (#1 to #5 and #296 to #300) close to the both ends of each head block 35 in the main scanning direction MSD which are targets of the arrangement-based correction.

In the example of the bypassing air flow correction table shown in FIG. 19B, the correction contents classified into three groups according to the coverage ratio (end area coverage ratio) are set for each of the nozzles 38 (#1 to #5 and #296 to #300) close to both ends (in end area) of each head block in the main scanning direction MSD. Specifically, correction coefficients 0.9 to 0.97 are set as the correction contents after addition for the coverage ratio "to 0.5 (smaller than 0.5)". Similarly, correction coefficients 0.87 to 0.97 are set as the correction contents after addition for the coverage ratio "0.5 to 0.7 (equal to or larger than 0.5 and smaller than 0.7)", and correction coefficients 0.85 to 0.97 are set as the correction contents after addition for the coverage ratio "0.7 to 1.0 (equal to or larger than 0.7 and equal to or lower than 1.0)". When the ink is consecutively ejected from all of the nozzles near the ends, the end area coverage ratio is density 1.

Moreover, also in the embodiment, the correction contents of each group according to the coverage ratio can be determined as follows. For example, the degree of landing deviation of the ink in the main scanning direction MSD due to the bypassing air flow W3 is grasped from a test pattern provided for each level of coverage ratio (ink ejection density) which is printed by the inkjet printing apparatus 1, and the correction contents are determined based on the grasped degree.

In the embodiment, particularly, the correction contents according to the coverage ratio are determined for the nozzles 38 close to both end portions of the head block 35 in the main scanning direction MSD. Accordingly, it is preferable that the test pattern to be printed by the inkjet printing apparatus 1 in the determination of the correction contents of each group according to the coverage ratio includes many patterns which are printed in such a way that the nozzles 38 including the nozzles 38 close to both ends eject the ink in different levels of coverage ratio (ejection density) in each of the main scanning direction MSD and the sub-scanning direction SSD.

Figure 20:
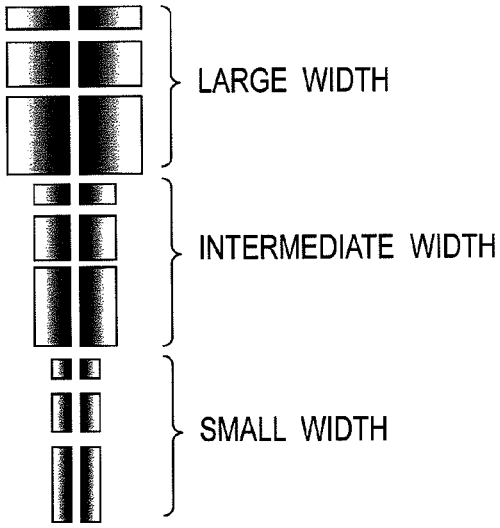
FIG. 20 is an explanatory diagram showing an example of a test pattern used to determine correction contents of the bypassing air flow correction table in FIG. 19B.

The test pattern shown in the explanatory diagram of FIG. 20 can be thus used. The test pattern includes, for each two of the head blocks 35 adjacent in the main scanning direction MSD, three groups each formed by ejecting the ink from a large, intermediate, or small (large width, intermediate width, and small width in the drawing) [0] number of the nozzles 38 consecutive in the main scanning direction MSD from both ends. Moreover, each group includes three patterns each formed by ejecting the ink a large, intermediate, or small number of times from each nozzle 38 consecutively in the sub-scanning direction SSD.

The correction contents can be thus determined as follows. The degree of landing deviation of the ink in the main scanning direction MSD due to the bypassing air flow W3 is grasped for each level of two-dimensional coverage ratio (dot density) in the main scanning direction and the sub-scanning direction, by using the test pattern including patterns having three different levels of dot density of large, intermediate, and small in each of the main scanning direction and the sub-scanning direction. Then, the correction contents are determined based on the grasped degree.

Next, description is given of procedures performed to determine the correction contents of the bypassing air flow correction table in FIG. 19B.

Figure 21:
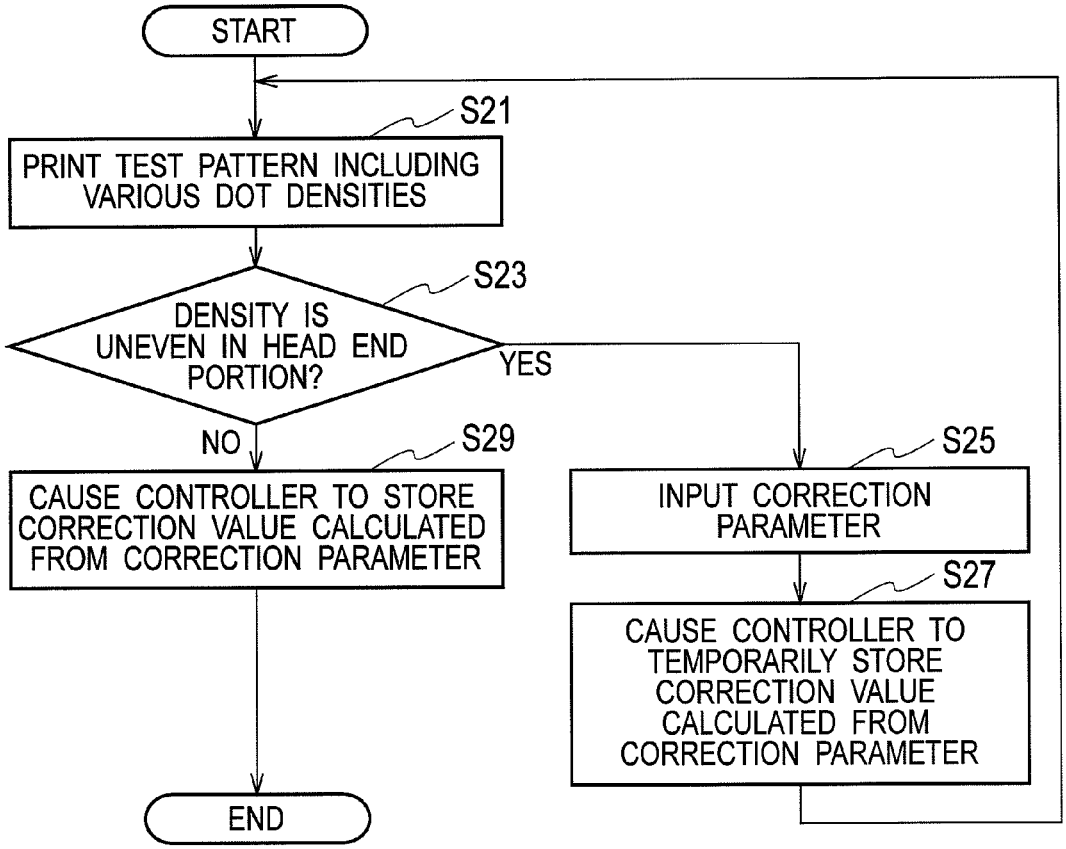
FIG. 21 is a flowchart for explaining procedures performed to determine the correction contents of the bypassing air flow correction table in FIG. 19B.

FIG. 21 is a flowchart for explaining operations performed by the inkjet printing apparatus 1 to determine the correction contents of the bypassing air flow correction table. The processing of the flowchart of FIG. 21 starts when image data of the test pattern in FIG. 20 is inputted to the inkjet printing apparatus 1.

In step S21 of FIG. 21, the controller 5 prints, by using the printing unit 4, the test pattern (including image portions having high, intermediate, and low dot densities) read from, for example, the hard disk. At this time, the controller 5 performs the arrangement-based correction of the ink ejection amounts of the five nozzles 38 from each end of the head block 35 of each color in the main scanning direction MSD, by using the arrangement-based correction table in FIG. 18B stored in the hard disk in advance.

After the test pattern is printed on the paper sheet PA, the test pattern image on the printed paper sheet PA is checked to determine whether the density is uneven in portions of the test pattern image to which the ink is ejected by the nozzles 38 close to both ends of the head block 35 in the main scanning direction MSD (step S23).

When the density is uneven (YES in step S23), the user, for example, operates a not-illustrated operation panel to input an updated correction parameter for eliminating the uneven density to the inkjet printing apparatus 1 (step S25). Then, the inkjet printing apparatus 1 calculates the correction contents of the arrangement-based correction table for each level of dot density (i.e. for each level of coverage ratio, that is, for each level of ink ejection density) of each color from the inputted updated correction parameter, and temporarily stores the correction contents in the not-illustrated hard disk of the controller 5 or the like (step S27). Thereafter, the processing returns to step S21.

Moreover, when the density is even in step S23 (NO), the correction contents of the arrangement-based correction table which are currently temporarily stored in the hard disk or the like are actually stored again in the hard disk or the like as the correction contents of the bypassing air flow correction table (step S29). Thereafter, the processing is terminated.

Moreover, the correction contents can be determined as follows. The reading device of the reader 6 reads the test pattern image and the controller 5 determines whether the uneven density exists or not. Then, the controller 5 inputs the updated correction parameter on the basis of the result of the determination. The printing of the test pattern and the reading of the image are thus repeated and the controller 5 thereby determines the correction contents of the bypassing air flow correction table without the user performing the input operation and the like.

Next, description is given of operations performed by the inkjet printing apparatus 1 to correct the ink ejection amounts of the nozzles 38 close to both ends of each head block 35 in the main scanning direction MSD are corrected by applying the correction contents of the bypassing air flow correction table in FIG. 19B.

Figure 22:
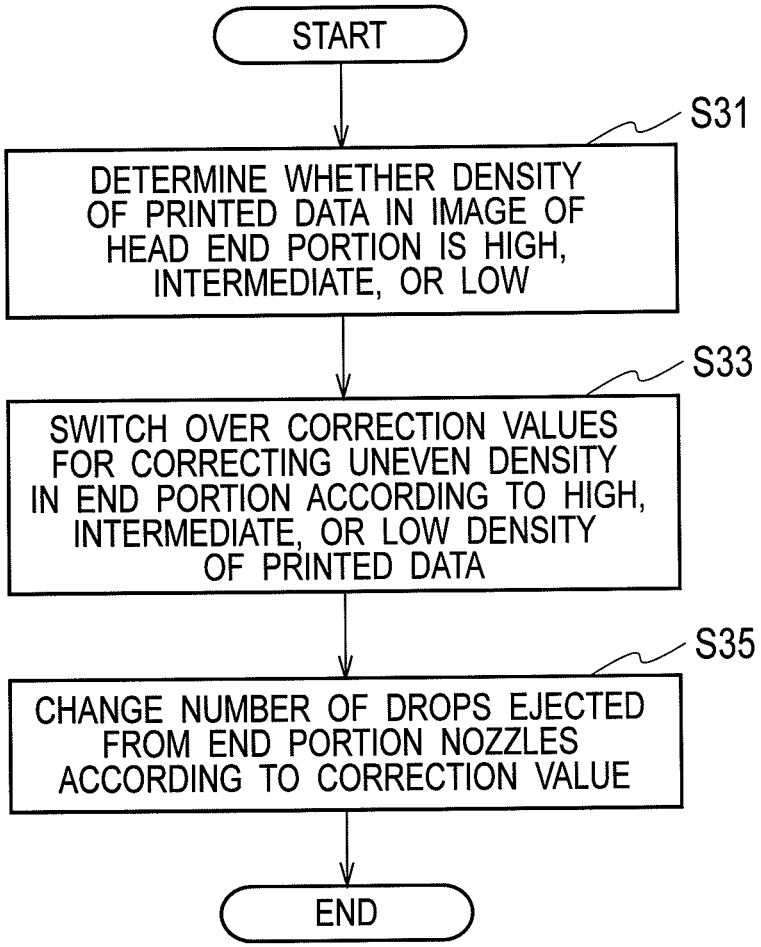
FIG. 22 is a flowchart for explaining the operations performed by the inkjet printing apparatus to correct the ink ejection amounts of the nozzles close to both ends in the main scanning direction MSD in a downstream head module of each head block by using the correction contents of the arrangement-based correction table in FIG. 18B and the correction contents of the bypassing air flow correction table in FIG. 19B.

FIG. 22 is a flowchart for explaining the operations performed by the inkjet printing apparatus 1 to correct the ink ejection amounts of the nozzles close to both ends of the head block 35 in the main scanning direction MSD are corrected by applying the correction contents of the bypassing air flow correction table. The processing of the flowchart of FIG. 22 starts when image data of a printing target is inputted to the inkjet printing apparatus 1 and droplet data which is image data of a format corresponding to the printing by the inkjet heads 31 is generated by the controller 5 from image data of a RGB format.

In step S31 of FIG. 22, for each color, assuming that pixels in the droplet data corresponding to the nozzles 38 close to both ends in the main scanning direction MSD in the downstream head module 36D of the head block 35 are set to be target pixels, the controller 5 determines to which one of the high, intermediate, and low levels does the dot density of each target pixel belongs, by using the droplet data of the target pixel and nearby pixels (pixels on both sides in the main scanning direction MSD and on upstream side in the sub-scanning direction SSD).

Next, the controller 5 determines the correction contents corresponding to the dot density (high, intermediate, and low), i.e. coverage ratio, of each target pixel determined in step S31, by using the bypassing air flow correction table in FIG. 19B. Then, the contents of the arrangement-based correction performed by the controller 5 on the ink ejection amounts of the nozzles 38 in the downstream head module 36D which correspond to the target pixels are switched from the correction contents set in the arrangement-based correction table in FIG. 18B to contents to which the determined correction contents are added (step S33).

As is apparent from the aforementioned description, an arrangement-based correction portion is formed of the controller 5 in the embodiment.

The controller 5 thus adjusts and controls the ink ejection amounts of the nozzles 38 close to both ends in the main scanning direction MSD in the downstream head module 36D, according to the switched correction contents, by changing the droplet data (step S35).

Hence, it is possible to suppress a case where the ink which is ejected from the nozzles 38 close to both ends in the main scanning direction MSD in the downstream head module 36D and whose ejection amount has been controlled in the arrangement-based correction is swept away in the main scanning direction MSD by the bypassing air flow W3 and the landing deviation of the ink occurs as shown in FIG. 19A. Accordingly, the ink-landing state becomes similar to an ink-landing state where no landing deviation in the main scanning direction MSD is caused by the bypassing air flow W3, and the image forming apparatus can form an excellent image in which the white stripe and the black stripe are suppressed.

Third Embodiment

Next, description is given of an inkjet printing apparatus in a third embodiment of the present invention. Note that the structure of the inkjet printing apparatus in the third embodiment is the same as that of the inkjet printing apparatus 1 in the first and second embodiments.

The inkjet printing apparatus 1 in the first embodiment additionally corrects the correction contents of the ink ejection amounts for the seam correction, according to the landing deviation amounts of the ink in the main scanning direction MSD due to the bypassing air flow W3, the correction contents set for the nozzles 38 in the downstream head modules 36D which are located in the seam portion b2 (see FIG. 6) of the adjacent two head blocks 35.

On the other hand, the inkjet printing apparatus 1 of the third embodiment additionally corrects correction contents of ink ejection amounts for eliminating uneven density on a paper sheet PA due to individual differences (characteristics difference) among nozzles 38 in downstream head modules 36D, according to landing deviation amounts of ink in a main scanning direction MSD due to a bypassing air flow W3.

Description is given below of how the density becomes uneven on the paper sheet PA due to the individual differences (characteristic differences) among the nozzles 38 in the downstream head modules 36D.

As described also in the second embodiment, the nozzles 38 and multiple ink chambers (not illustrated) communicating with the nozzles 38 are provided inside an upstream head module 36U and the downstream head module 36D of each of head blocks 35. A controller 5 performs control to change the capacity of each ink chamber and the ink in the ink chamber is thereby ejected from the corresponding nozzle.

In such shear-mode head modules 36U, 36D, characteristics of the ink ejection amounts vary due to individual differences (characteristic differences) among elements (for example, piezoelectric members forming partition walls of the ink chambers) for changing the capacities of the ink chambers.

Figures 23A, 23B:
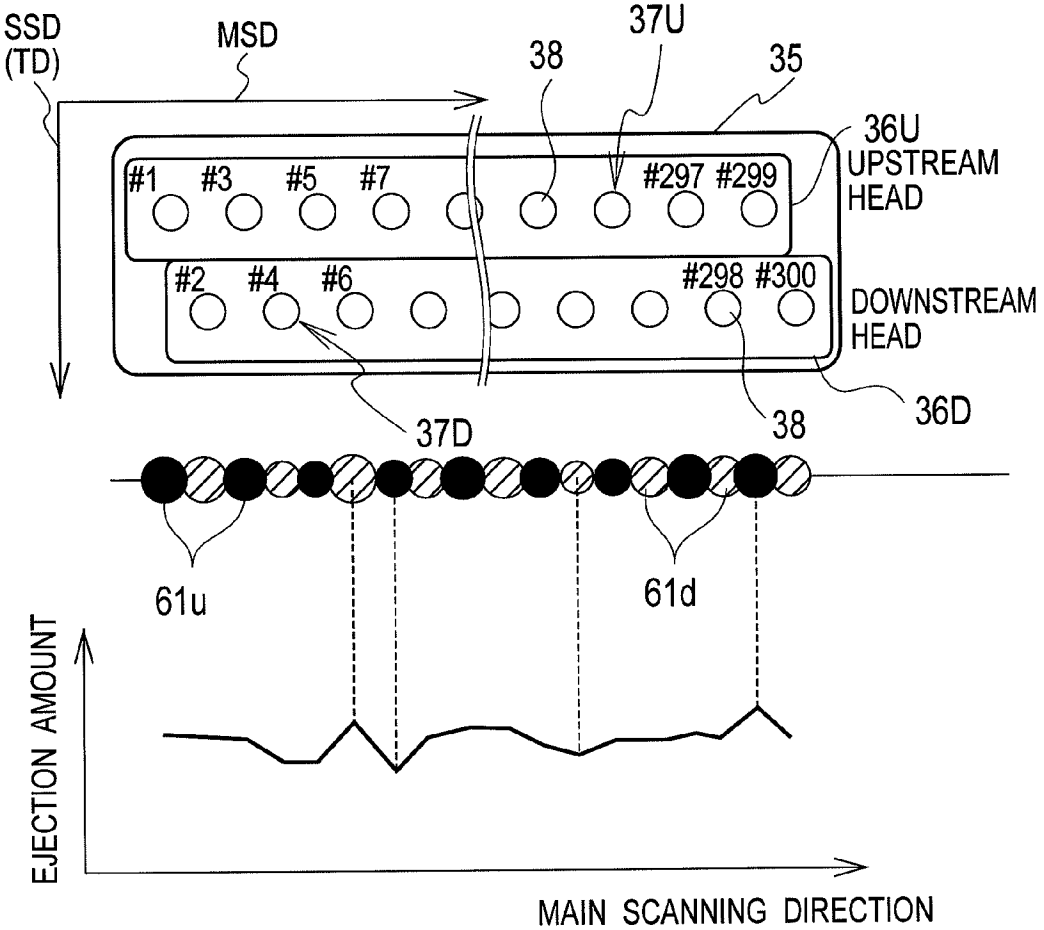
FIG. 23A is an explanatory diagram showing a relationship between nozzles and ink ejection amounts of the nozzles in a head block of an inkjet printing apparatus in a third embodiment of the present invention.
FIG. 23B is an explanatory diagram showing an example of an offset correction table stored in the controller of FIG. 2 for the nozzles of FIG. 23A.

In the arrangement example shown in FIG. 23A, the diameters of dots formed by ejecting ink of the same amount from the nozzles 38 in the upstream head module 38U and the downstream head module 38D vary among the nozzles 38 (i.e. the ejection amounts vary among the nozzles 38), and the density becomes uneven in an image due to this variation.

In order to prevent occurrence of uneven density, the controller 5 corrects the ink ejection amounts of the nozzles 38 in the upstream head module 36U and the downstream head module 36D by using correction contents set for the nozzles 38 in an offset correction table stored in, for example a hard disk, as in the example of the offset correction table shown in FIG. 23B.

In the correction by the controller 5 which uses the correction contents set in the aforementioned offset correction table, no consideration is made of a bypassing air flow generated in the downstream head module 36D by a self-generated air flow W1 and a transfer air flow W2, the self-generated air flow W1 generated by ejection of the ink by the nozzles 38 in the upstream head module 36U, the transfer air flow W2 generated by transport of the paper sheet PA by a transfer unit 3.

Hence, the controller 5 further corrects the correction contents set in the offset correction table on the basis of a generation degree of the bypassing air flow W3, i.e. a coverage ratio (dot density on the paper sheet PA) of the nozzles 38 in the downstream head module 36D. The controller 5 stores a bypassing air flow correction table in advance to perform this correction.

The bypassing air flow correction table is a table in which correction contents to be added to the correction contents of the ink ejection amounts set in the aforementioned offset correction table are set according to the generation degree of the bypassing air flow W3. Note that, also in the bypassing air flow correction table of the embodiment, the correction contents of the ink ejection amount are set to be classified by using the coverage ratio as the ink ejection density determining a self-generated air flow degree affecting the generation degree of the bypassing air flow W3.

As in the first and second embodiments, the coverage ratio can be defined in a two-dimensional range by using the number of ink-ejected dots consecutive in the main scanning direction MSD and the number of ink-ejected dots consecutive in the sub-scanning direction SSD. Alternatively, the coverage ratio can be defined in a one-dimensional range by using only one of the numbers.

However, in the embodiment, the correction contents set in a seam correction table are classified according to the ink ejection density (coverage ratio) additionally including the number of ink droplets ejected by the same nozzle 38 to the same dot, in addition to the numbers of ink-ejected dots consecutive in the main scanning direction and the sub scanning direction.

In other words, as in the arrangement example shown in FIG. 19A referred in the second embodiment, the ink ejected by the downstream head module 36D is swept toward the center of the head block 35 in the main scanning direction MSD by the bypassing air flow W3 and landing deviation of the ink occurs also in the embodiment.

Due to this landing deviation, an interval between droplets of ink ejected from adjacent nozzles 38 in the upstream head block 35 becomes uneven. If this is left as it is, a black stripe and a white stripe are formed. To counter this, the correction contents of the bypassing air flow correction table stored in, for example, the hard disk of the controller 5 are applied to the nozzles 38 in the downstream head module 36D among the nozzles 38 being targets of the offset correction.

In the example of the bypassing air flow correction table shown in FIG. 24, the correction contents classified into three groups according to the coverage ratio are set for each of the nozzles 38 in the downstream head module 36D. Specifically, a correction coefficient 0 is set as the additional correction contents for the coverage ratio "to 0.5 (smaller than 0.5)". Similarly, correction coefficients +0.01 to +0.03 are set as the additional correction contents for the coverage ratio "0.5 to 0.7 (equal to or larger than 0.5 and smaller than 0.7)", and correction coefficients +0.01 to +0.03 is set as the additional correction contents for the coverage ratio "0.7 to 1.0 (equal to or larger than 0.7 and equal to or lower than 1.0)". When the ink is consecutively ejected from all of the nozzles in a certain range in the head, an intra-head data density is density 1.

Moreover, also in the embodiment, the correction contents of each group according to the coverage ratio can be determined as follows. The degree of landing deviation of the ink in the main scanning direction MSD due to the bypassing air flow W3 is grasped from a test pattern provided for each level of coverage ratio (ink ejection density) which is printed by the inkjet printing apparatus 1, and the correction contents are determined based on the grasped degree.

In the embodiment, the correction contents according to the coverage ratio are determined for each nozzle 38. Accordingly, it is preferable that the test pattern to be printed by the inkjet printing apparatus 1 in the determination of the correction contents of each group according to the coverage ratio includes many patterns which are printed in such a way that all of the nozzles 38 eject the ink in different coverage ratios (ejection densities) in each of the main scanning direction MSD and the sub-scanning direction SSD.

Moreover, in the embodiment, since the number of ink droplets ejected to the same dot by the same nozzle 38 is additionally included into the coverage ratio (ejection density), the test pattern preferably includes patterns different in the number of ink droplets ejected to the same dot.

The test patterns shown in the explanatory diagrams of FIGS. 25A and 25B can be thus used. Each of the test patterns includes three groups each formed by ejecting the ink from a large, intermediate, or small (large width, intermediate width, and small width in the drawing) [0] number of the nozzles 38 consecutive in the main scanning direction MSD. Moreover, each group includes three patterns each formed by ejecting the ink a large, intermediate, or small number of times from each nozzle 38 consecutively in the sub-scanning direction SSD. Furthermore, two types of such test patterns each including the three groups are provided. The number of ink droplets ejected to the same dot is N droplets in one type (FIG. 25A) and is N+1 droplets in the other type (FIG. 25B).

The correction contents can be thus determined as follows. The degree of landing deviation of the ink in the main scanning direction MSD due to the bypassing air flow W3 is grasped for each coverage ratio by using the test patterns described above, the each coverage ratio obtained by additionally including the number of ink droplets ejected to the same dot to the two-dimensional coverage ratio (dot density)

in the main scanning direction and the sub-scanning direction. Then, the correction contents are determined based on the grasped degree.

Note that procedures performed to determine the correction contents of the bypassing air flow correction table in FIG. 24 and operations performed by the inkjet printing apparatus 1 to correct the ink ejection amounts of the nozzles 38 close to both ends of the head block 35 in the main scanning direction MSD by applying the determined correction contents of the bypassing air flow correction table are basically the same as the contents of the second embodiment which are described with reference to the flowcharts of FIGS. 21 and 22. However, the nozzles 38 which are the targets of correction are different from those of the second embodiment.

As is apparent from the aforementioned description, an offset-correction unit is formed of the controller 5 in the embodiment.

Moreover, also in the embodiment, it is possible to suppress a case where the ink which is ejected from the nozzles 38 in the downstream head module 36D and whose ejection amount has been controlled in the offset correction is swept away in the main scanning direction MSD by the bypassing air flow W3 and the landing deviation of the ink occurs. Hence, the ink-landing state becomes similar to an ink-landing state where no landing deviation in the main scanning direction MSD is caused by the bypassing air flow W3, and the image forming apparatus 1 can form an excellent image in which the white stripe and the black stripe are suppressed.

Also in the second and third embodiments described above, the correction contents of the ink ejection amounts set in the bypassing air flow correction tables in FIGS. 19B and 24 can further classified according the size of the head gap H and be set in such a way that (the correction coefficients of) the correction contents to be added to the correction contents for the seam correction increase as the head gap H increases.

Moreover, also in the second and third embodiments described above, the correction contents of the ink ejection amounts set in the bypassing air flow correction tables in FIGS. 19B and 24 can be further classified according to the transfer speed of the paper sheet PA by the transfer unit 3 and set in such a way that (the correction coefficients of) the correction contents to be added to the correction contents for the arrangement-based correction increase as the transport speed increases.

In the first and third embodiments described above, description is given of a case where the correction contents of the ink ejection amounts used to eliminate factors other than the landing deviation in the main scanning direction MSD due to the bypassing air flow W3 is additionally changed in consideration of the landing deviation. However, the present invention can be widely applied to a case where the ink ejection amount is controlled according to the generation degree of the bypassing air flow W3 (bypassing air flow degree) on the basis of the ink ejection density.

In the first and third embodiments, description is given of a case where each inkjet head 31 is formed by arranging the multiple (six) head blocks 35 in the main scanning direction MSD in a zigzag pattern and the upstream nozzle array 37U and the downstream nozzle array 37D of each head block 35 are arranged at positions offset from each other in the transfer direction TD (sub-scanning direction SSD) of the paper sheet PA by the transfer unit 3.

However, the second and third embodiments in particular can be applied to a case where an upstream nozzle array and a downstream nozzle array covering a print width in the main scanning direction MSD are provided in the inkjet head 31 of a single member.

Moreover, the present invention can be applied to an inkjet printing apparatus in which each inkjet head 31 has three or more nozzle arrays arranged at positions offset from one another in the transfer direction TD (sub-scanning direction SSD) of the paper sheet PA by the transfer unit 3. In this case, the controller 5 can use the density of ejection target pixels of at least one of the nozzle arrays except for the nozzle array at the downstream end, to determine whether the ink wall is formed in the at least one of the nozzle arrays and a nozzle array upstream thereof. For example, the nozzle arrays other than the nozzle array at the downstream end are collectively assumed to be the upstream nozzle array 37U in the embodiments described above, and presence and absence of the high-ejection-density region is determined to determine whether the ink wall is formed or not. Moreover, also in the above case, whether the ink wall is formed or not can be determined by using the number of ink droplets ejected to each ejection target pixel, in addition to the density of ejection target pixels of the at least one of the nozzle arrays other than the nozzle array at the downstream end.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An image forming apparatus comprising:

a transfer route configured to transfer a recording medium in a transfer direction;

an inkjet head arranged above the transfer route and including a plurality of nozzles arrays, the plurality of nozzles arrays being arranged at positions offset from one another in the transfer direction and having nozzles configured to eject ink to form an image on the recording medium; and a controller configured to adjust ink ejection amounts from the nozzles in a downstream nozzle array on a basis of an ejection density of ink ejected from the nozzles in an upstream nozzle array on the recording medium, the downstream nozzle array being a nozzle array located downstream in the transfer direction among the plurality of nozzle arrays, the upstream nozzle array being a nozzle array located upstream in the transfer direction among the plurality of nozzle arrays, wherein the controller is configured to adjust the ink ejection amounts from the nozzles in the downstream nozzle array on a basis of a bypassing air flow degree calculated based on the ejection density and indicating a generation degree of a bypassing air flow generated when a transfer air flow generated by transfer of the recording medium bypasses a self-generated air flow generated by ink ejected from the nozzles in the upstream nozzle array.

2. The image forming apparatus according to claim 1, wherein the ejection density is determined based on at least one of a number of the nozzles consecutive in a main scanning direction orthogonal to the transfer direction which eject ink or a number of lines consecutive in the transfer direction which include dots formed by ejection of ink from the same nozzle.

3. The image forming apparatus according to claim 2, wherein the ejection density is determined based on a number of ink droplets ejected to a same dot by the same nozzle.

4. The image forming apparatus according to claim 1, wherein the inkjet head includes a plurality of head blocks arranged in a zigzag pattern along a main scanning direction orthogonal to the transfer direction, the plurality of nozzle arrays are disposed in each of the head blocks, and for each of the head blocks, the controller is configured to adjust the ink ejection amounts from the nozzles in the downstream nozzle array on a basis of the bypassing air flow degree.

5. The image forming apparatus according to claim 4, wherein the controller includes a seam correction unit configured to correct an ink ejection amount of ink ejected from each of the nozzles located in a seam portion by using a correction content set based on an interval between the nozzles in the main scanning direction, the seam portion being a portion in which the head blocks adjacent to each other in the main scanning direction overlap each other in the transfer direction, and the controller is configured to further correct the correction content used by the seam correction unit of the ink ejection amounts from the nozzles in the downstream nozzle array on a basis of the bypassing air flow degree.

6. The image forming apparatus according to claim 1, wherein the controller includes an arrangement-based correction unit configured to correct an ink ejection amount of each of the nozzles by using a correction content set based on arrangement of the nozzles in the inkjet head in a main scanning direction orthogonal to the transfer direction, and the controller is configured to further correct the correction content used by the arrangement-based correction unit of the ink ejection amounts from the nozzles in the downstream nozzle array on a basis of the bypassing air flow degree.

7. The image forming apparatus according to claim 6, wherein the controller is configured to adjust the ink ejection amount from each of the nozzles in the downstream nozzle array on a basis of the bypassing air flow degree, by using a content unique to each of the nozzles.

8. The image forming apparatus according to claim 1, wherein the controller includes an offset correction unit configured to correct an ink ejection amount of each of the nozzles by using a correction content set based on variation in ink ejection characteristics of the nozzles, and the controller is configured to further correct the correction content used by the offset correction unit of the ink ejection amounts from the nozzles in the downstream nozzle array on a basis of the bypassing air flow degree.

9. The image forming apparatus according to claim 8, wherein the controller is configured to adjust the ink ejection amount from each of the nozzles in the downstream nozzle array on a basis of the bypassing air flow degree, by using a content unique to each of the nozzles.

10. The image forming apparatus according to claim 1, further comprising a head gap adjuster configured to adjust a head gap being a gap between the inkjet head and the recording medium, wherein the controller is configured to adjust the ink ejection amounts of the nozzles in the downstream nozzle array, according to the head gap.

11. The image forming apparatus according to claim 1, wherein the controller is configured to determine adjustment contents of the ink ejection amounts of the nozzles in the downstream nozzle array, according to a transfer speed of the recording medium.

* * * * *